US007291071B2

(12) United States Patent
McNamara, III

(10) Patent No.: US 7,291,071 B2
(45) Date of Patent: Nov. 6, 2007

(54) COMPACT GOLF FACILITY AND A METHOD OF PLAYING A GOLF GAME

(75) Inventor: Edward John McNamara, III, St. Marys, MO (US)

(73) Assignee: Innovative Golf Solutions, LLC, Scottsdale, AZ (US)

( * ) Notice: Subject to any disclaimer, the term of this patent is extended or adjusted under 35 U.S.C. 154(b) by 0 days.

(21) Appl. No.: 11/601,043

(22) Filed: Nov. 17, 2006

(65) Prior Publication Data

US 2007/0066414 A1 Mar. 22, 2007

Related U.S. Application Data

(63) Continuation-in-part of application No. 10/344,757, filed as application No. PCT/US00/22181 on Aug. 12, 2000, now Pat. No. 7,037,208.

(51) Int. Cl.
*A63B 67/02* (2006.01)

(52) U.S. Cl. ..... 473/169; 473/409

(58) Field of Classification Search ..... 473/167–172, 473/278, 279, 409
See application file for complete search history.

(56) References Cited

U.S. PATENT DOCUMENTS 2,445,806 A 7/1948 Reach ..... 318/212
3,671,042 A * 6/1972 Garber ..... 473/165
3,990,708 A 11/1976 Ingwersen ..... 473/153
4,225,136 A 9/1980 Beam ..... 473/159
5,431,402 A * 7/1995 Aguilera ..... 473/169
5,443,870 A 8/1995 Lurie et al. ..... 428/17
5,490,671 A * 2/1996 Picard ..... 473/168
5,655,974 A 8/1997 Bair ..... 473/153
7,037,208 B1 * 5/2006 McNamara, III ..... 473/169
7,137,901 B2 * 11/2006 McNamara, III ..... 473/169

* cited by examiner

*Primary Examiner*—Mark S Graham
(74) *Attorney, Agent, or Firm*—Harness, Dickey & Pierce, P.L.C.

(57) ABSTRACT

A method of playing a golf-type game at the facility comprises placing a ball at one of the starting points, hitting the ball toward the appropriate target, and determining the surface type on which further play continues or determining the score based upon where the ball lands relative to scoring zones. A facility for playing a golf-type game includes a plurality of short-shot holes, each short-shot hole comprising a starting box on which a ball can be placed, and a target comprising a cup for receiving a ball hit from the starting box, and a plurality of scoring zones surrounding the cup; the target zones having indicia for scoring.

12 Claims, 8 Drawing Sheets

GOLF COURSE/LOCATION: PALM/TOP FLOOR

| HOLE | 1 | 2 | 3 | 4 | 5 | 6 | 7 | 8 | 9 | |
|---|---|---|---|---|---|---|---|---|---|---|
| PAR | 4 | 5 | 3 | 4 | 1 | 5 | 2 | 4 | 3 | |
| TEE SHOT SLOT/TYPE | 326/Pi | 399/Pi | 360/St | 352/Ch | 371/Pu | 302/Pi | 359/Ch | 363/St | 397/Pi | |
| 2ND SHOT SLOT: | | | | | | | | | | |
| PITCHING | 301 | 349 | | 300 | | 341 | | 303 | | |
| CHIPPING | 351 | 353 | | | | 358 | | | | |
| SANDTRAP | 366 | 362 | | | | 367 | | | | |
| PUTTING | | | 395 | | | | | | | |
| 3RD SHOT SLOT: | | | | | | | | | | |
| PITCHING | | 310 | | | | 338 | | | | |
| CHIPPING | | 353 | | | | 357 | | | | |
| SANDTRAP | | 362 | | | | 365 | | | | |
| PUTTING | 370 | | | | | | | 386 | | |
| 4TH SHOT SLOT: | | | | | | | | | | |
| PUTTING | | | | | | | | | | |
| PLAYER #1 TOTAL: | | | | | | | | | | |
| PLAYER #2 TOTAL: | | | | | | | | | | |
| PLAYER #3 TOTAL: | | | | | | | | | | |
| PLAYER #4 TOTAL: | | | | | | | | | | |

Pi=PITCHING Ch=CHIPPING St=SANDTRAP Pu=PUTTING

◯ = USE SCORING ZONES TO ADD STROKES FOR FINAL HOLE

SCORING ZONES

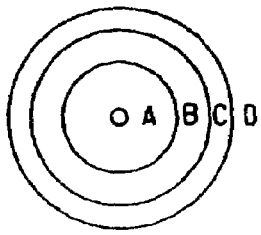

FIG. 9

COMPACT GOLF FACILITY AND A METHOD OF PLAYING A GOLF GAME

CROSS REFERENCE TO RELATED APPLICATIONS

This application is a continuation-in-part of patent application Ser. No. 10/344,757, filed Feb. 12, 2003, now issued U.S. Pat. No. 7,037,208, entitled "Compact Golf Facility and a Method of Playing A Golf Game", which claims priority from International Application PCT/US00/22181, filed Aug. 12, 2000, the disclosures of which are incorporated herein by reference.

FIELD OF THE INVENTION

This invention relates to a compact golf facility, and a method of playing a golf-type game using golf's short game shots.

BACKGROUND OF THE INVENTION

There is a year round demand for golf course play and practice facilities, particularly in colder climates where weather conditions prevent year round play. However, it would be difficult and expensive to provide an indoor golf course driving range. Amateur golfers primarily practice at outdoor driving ranges, which allow practice of golf's long game, but do not provide practice of golf's short game which comprises as much as two-thirds of the shots in a typical round of golf. Furthermore, there is no practice facility that allows golfers to practice their short game skills, such as pitches, chips and sand trap shots, and actually "hole out".

SUMMARY OF THE INVENTION

The compact golf facility of the present invention is particularly adapted for playing a golf game, which makes playing of golf's short game interesting and challenging, thus encouraging practice. The facility is compact enough to be constructed indoors, to allow for year round play.

Generally, the facility comprises a plurality of short shot holes, each short shot hole comprising a starting box on which a ball can be placed, and a target comprising a cup for receiving a ball hit from the starting box, and a plurality of scoring zones surrounding the cup; the target zones having indicia for directing a player to continue play. The facility preferably includes a plurality of putting holes, each putting hole comprising a putting surface and a cup into which a ball can be putted from the putting surface.

The starting boxes and/or the targets can be grouped together so that the facility can be compactly arranged, and even constructed indoors, if desired, to facilitate year-round play and practice. Some of the starting boxes can have a turf surface on which the golf ball is placed, and from which the ball is hit. The height of the turf can vary to simulate different shot types on a golf course. Some of the starting boxes can have a sand surface, to simulate a sand trap.

The scoring zones comprising the targets are preferably segments of concentric circular rings surrounding the cup. In the preferred embodiment, there are putting holes and short shot holes of differing degrees of difficulty, and the scoring zones closer to the cup indicate continued hole play on less difficult holes, and the scoring zones further away from the cup indicate continued hole play on more difficult holes.

The method of playing a golf game of this invention allows the players to focus on their short game, in a challenging, competitive, and entertaining environment, which makes practicing more enjoyable. The method comprises completing a plurality of virtual golf holes, each virtual golf hole comprising a putting hole, and optionally one or more short shot holes; or a combination of one or more short shot holes and a putting hole. On short shot holes, a player hits from the starting box of the designated short shot hole, and continues play based upon which zone in the target the ball lands. On putting holes, a player starts at the designated starting point and putts until the ball is in the cup.

BRIEF DESCRIPTION OF THE DRAWINGS

FIG. 9 is a sample score card for use in playing a complete golf game at the facility.

Corresponding reference numerals indicate corresponding parts throughout the several views of the drawings.

DETAILED DESCRIPTION OF THE PREFERRED EMBODIMENT

Figure 1:
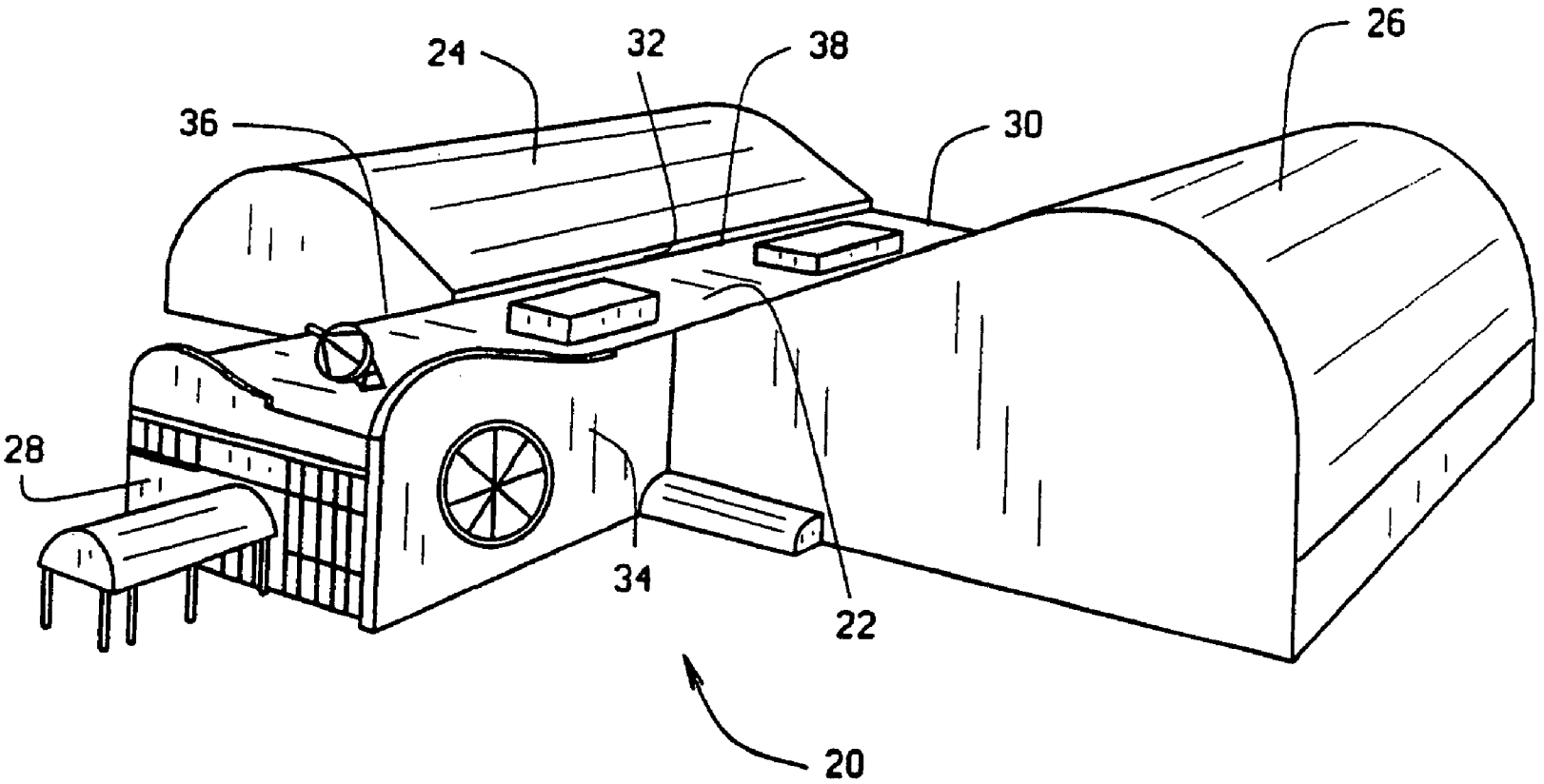
FIG. 1 is a perspective view of the exterior of a golf facility constructed according to the principles of this invention.
Figure 2:
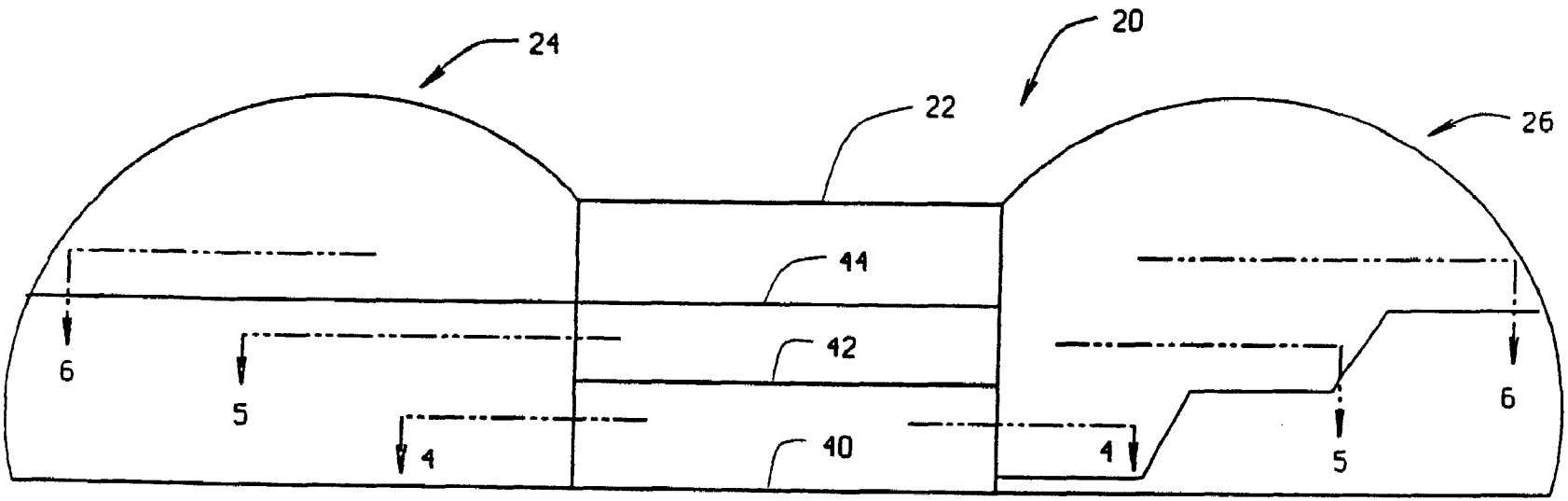
FIG. 2 is a transverse cross sectional view through the facility.
Figure 3:
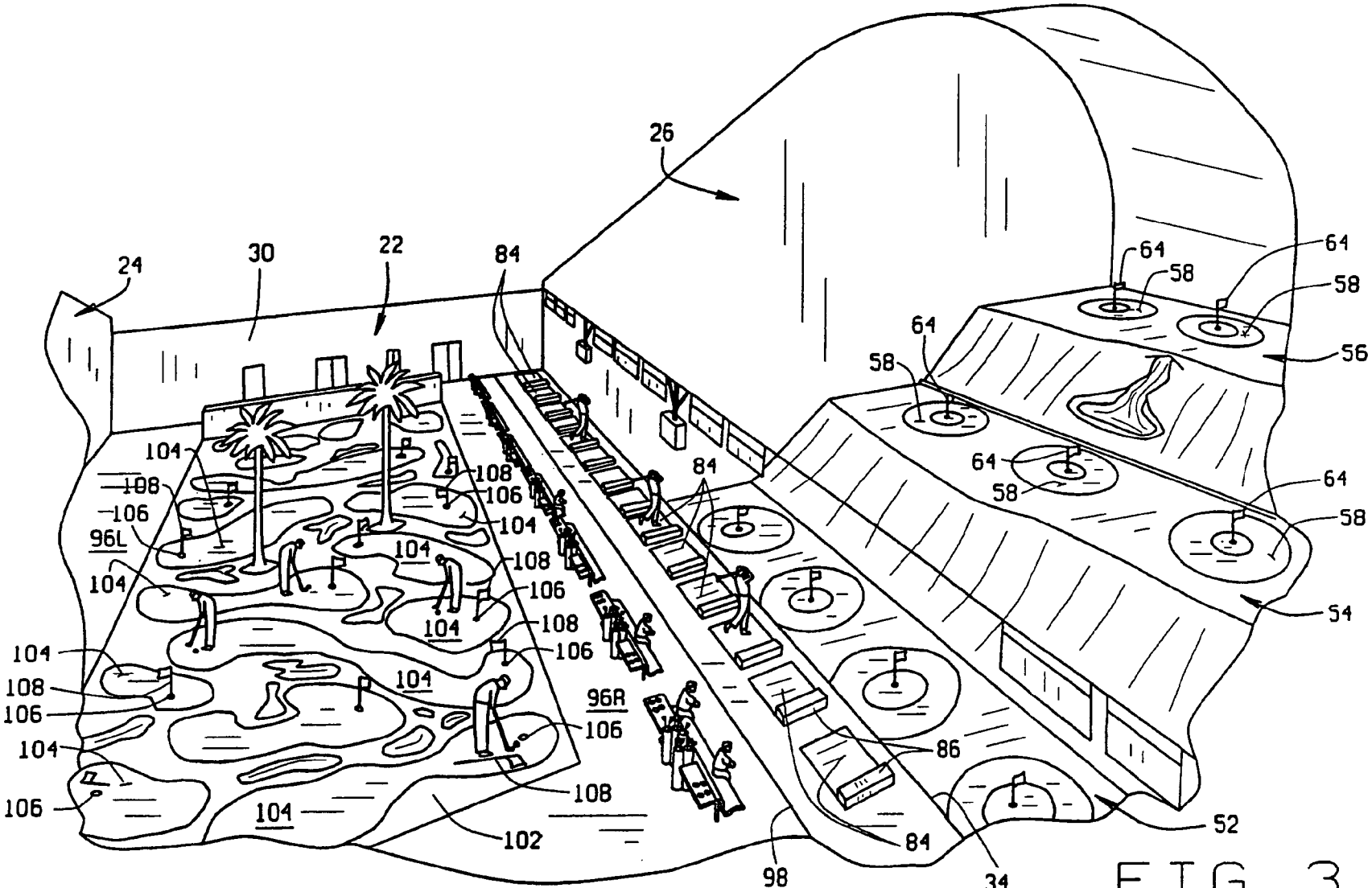
FIG. 3 is a perspective view of the interior of the facility.
Figure 4:
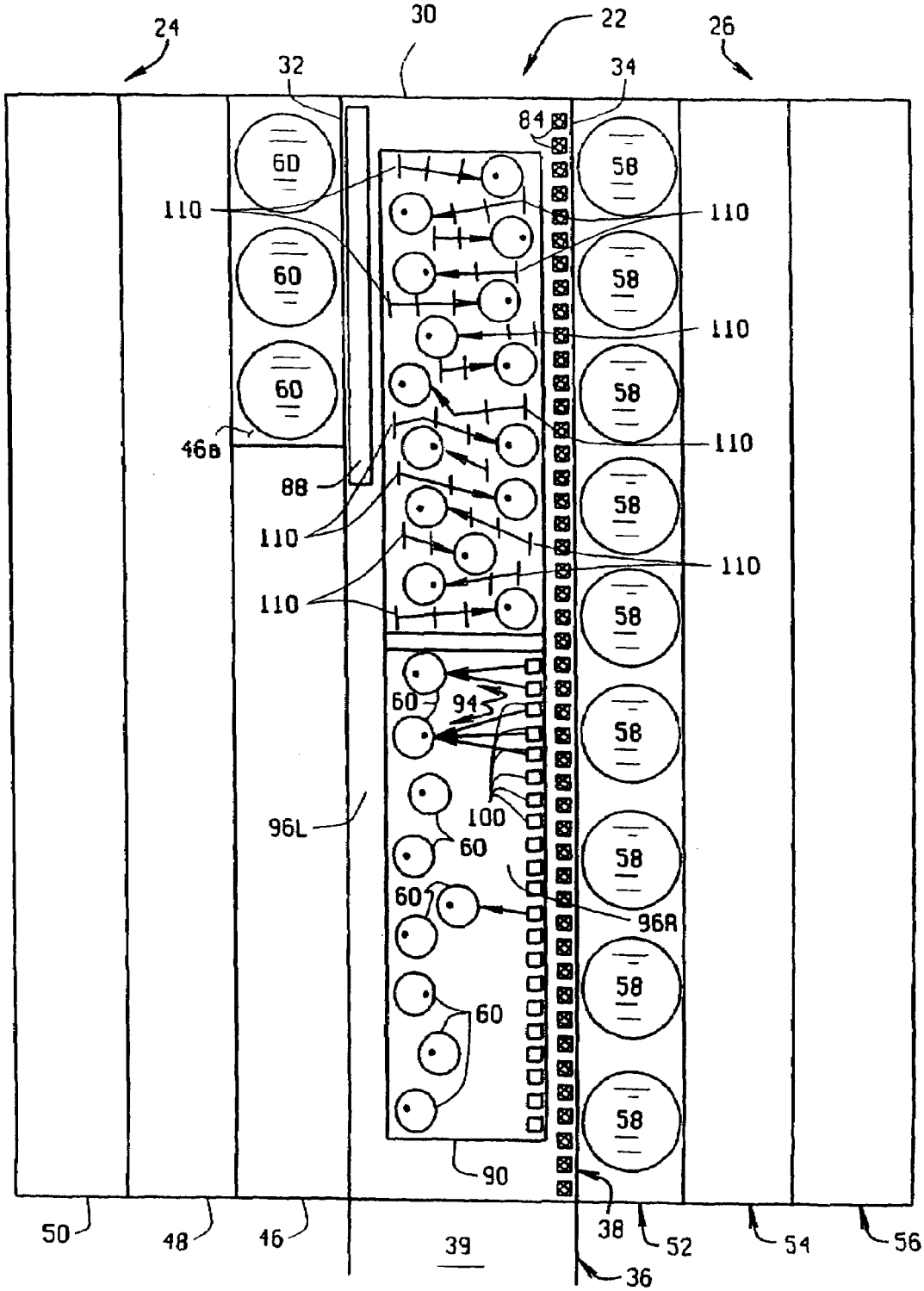
FIG. 4 is a cross sectional view of the first floor of the core area and the domed areas taken along the plane of line 4-4 in FIG. 2.
Figure 5:
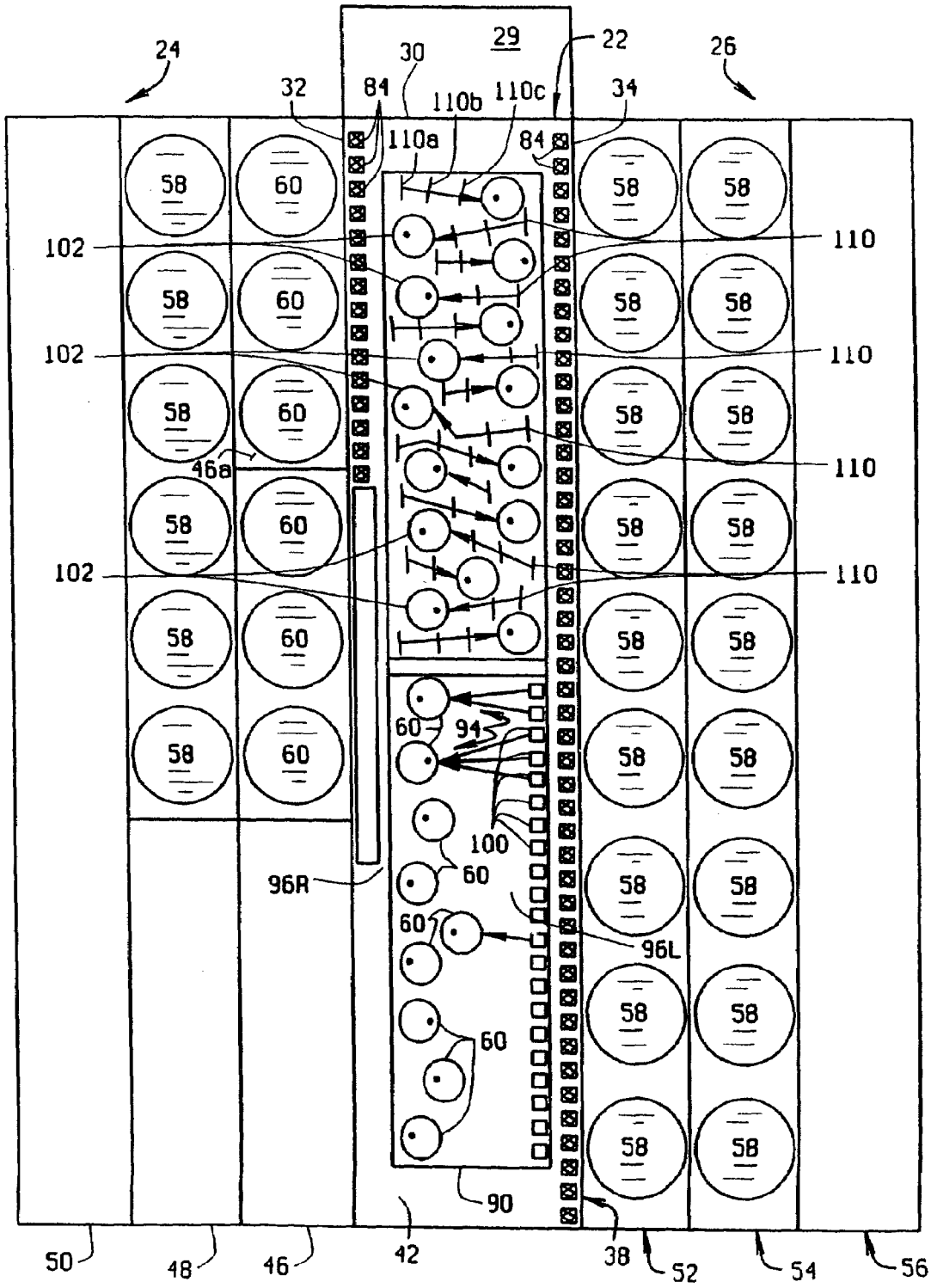
FIG. 5 is a cross sectional view of the second floor of the core area and the domed areas taken along the plane of line 5-5 in FIG. 2.
Figure 6:
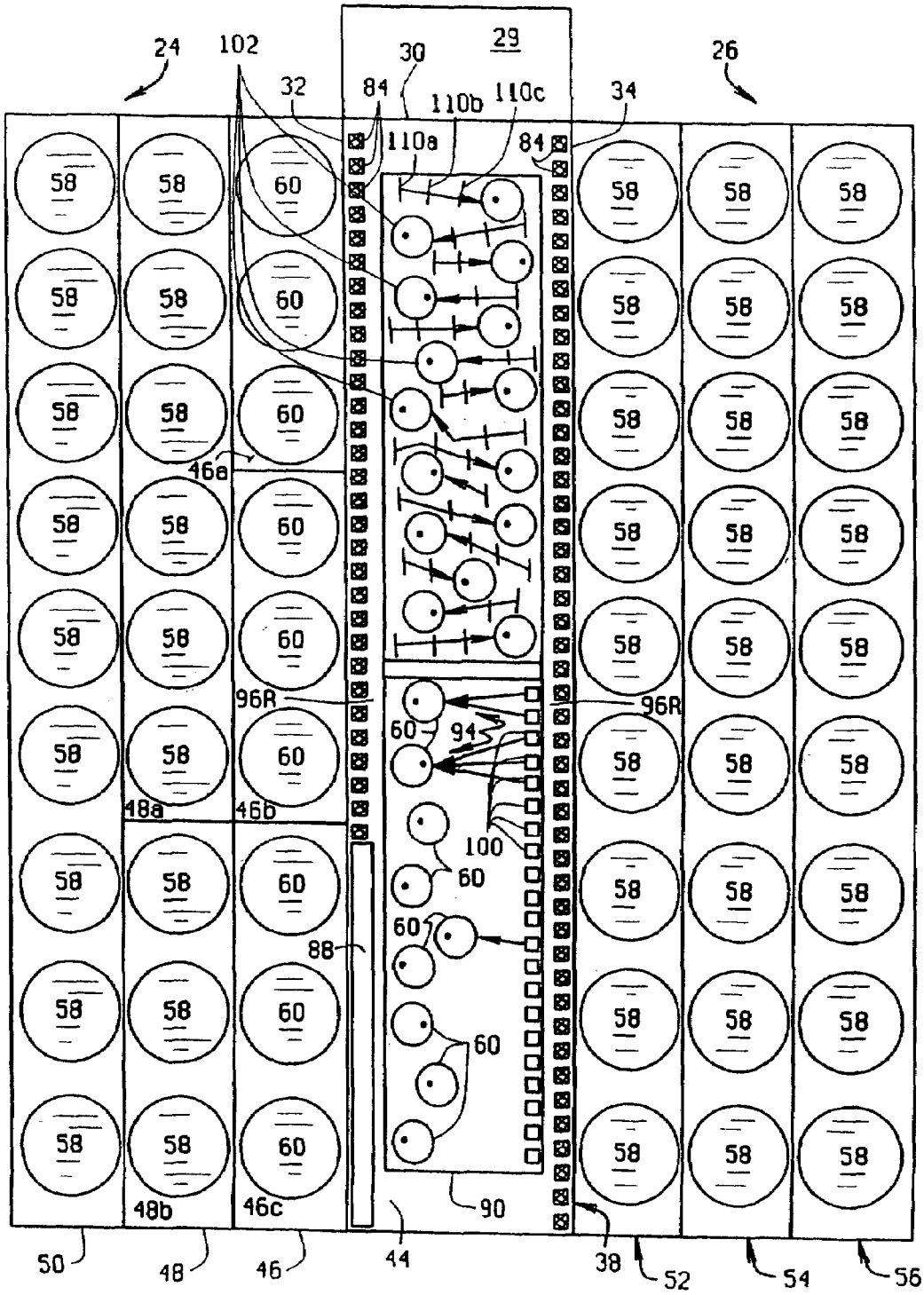
FIG. 6 is a cross sectional view of the third floor of the core area and the domed areas taken along the plane of line 6-6 in FIG. 2.

A compact golf facility constructed according to the principles of this invention is indicated generally as 20 in FIG. 1. The facility comprises a central core section 22, and first and second domed sections 24 and 26 on either side of the central core section.

In this preferred embodiment, the central core section 22 has a front 28, a back 30, and left and right sides 32 and 34. The central core section 22 is preferably divided into a forward portion 36 for housing administrative and other support facilities, and a rearward portion 38 for housing the play facilities. There could also be a limited distance, full swing practice hitting area 39 at the back of the rearward portion 38, if desired. The central core section 22 preferably has three levels or floors 40, 42, and 44, and the rearward portion 38 of each floor is open on the left side 32 to the first domed section 24, and on the right side 34 to the second domed section 26.

The domed section 24 contains three longitudinally extending rows 46, 48, and 50, of targets. The row 46 is closest the central section 22, and the row 50 is furthest from the central section. Similarly, the domed section 26 contains three longitudinally extending rows 52, 54, and 56 targets. The row 52 is closest to the central section 22, and the row 56 is further from the central section. The targets in the row 46 are on three levels: the targets in section 46*a* are generally on the same level as the first floor 40, the targets in section 46*b* are generally on the same level as the second floor 42, and the targets in section 46*c* are generally on the same level as the third floor 44. The targets in row 48 are on two different levels: the targets in section 48*a* are generally on the same level as the second floor 42, and the targets in section 48*b* are generally on the same level as the third floor 44. The targets in row 50 are all on the same level, which is generally the same level as the third floor 44. The targets in row 52 are all on the same level, which is generally the same level as the first floor 40. The targets in row 54 are all on the same level, which is generally the same level as the second floor 42. The targets in the row 56 are all on the same level, which is generally the same level as the third floor 44.

Figure 7:
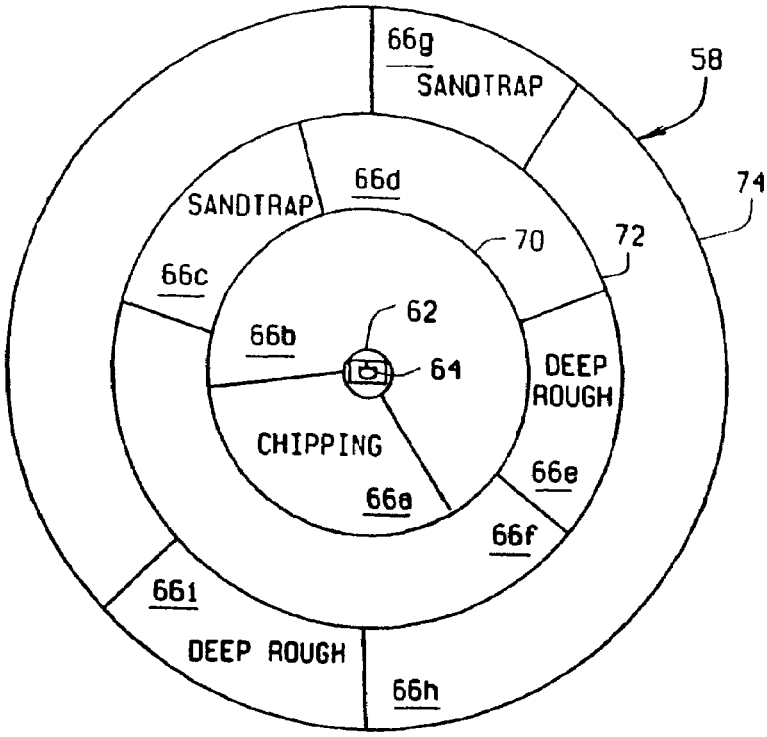
FIG. 7 is a top plan view of a target for pitching holes.

In this, preferred embodiment, there are two types of targets. All of the targets in rows 48, 50, 52, 54, and 56 are targets 58, shown in FIG. 7. All of the targets in the row 46 are targets 60, shown in FIG. 8. Each of the targets 58 comprises a cup 62, having a flag 64 therein, and surrounded by a plurality of scoring zones 66. As best shown in FIG. 7, the scoring zones 66 are segments of concentric rings surrounding the cup 62. The various scoring zones can be assigned particular scoring values (for example a number of strokes to add to a player's score) or the zones can provide information about where the player should continue play (for example on another short shot hole or on a putting hole, as described in more detail below). In this preferred embodiment, the target is divided into three concentric rings 70, 72, and 74. These rings are used to determine further play where play is to continue on a putting hole or where play does not continue on another hole. Where play continues on a putting hole, if a player's ball lands inside ring 70, then play continues on a short putting hole or the short start of a putting hole; if a player's ball lands outside ring 70, but inside rings 74, then play continues on an intermediate putting hole or an intermediate start of a putting hole; if a player's ball lands outside the rings 70, 72 and 74, the play continues on a long putting hole or a long start of a putting hole. Where player does not continue on another hole, then where the ball lands determines scoring. If a player's ball lands inside ring 70 then one stroke is added to the score; if a player's ball lands outside ring 70 but inside ring 74 then two strokes are added to the score; and if a player's ball lands outside the rings 70, 72 and 74 then three strokes are added to the score. Where play continues on a short shot hole, i.e., a pitching hole, a chipping hole, or a sand trap hole, then where play continues is determined by the segments 66. The inner ring 70 is divided into two scoring zones 66*a* and 66*b*. The scoring zone 66*a* is labeled "chipping" signifying that the player whose ball lands in zone 66*a* is to continue playing on a chipping hole assigned to that hole. The scoring zone 66*b* is unlabeled, signifying that the player whose ball lands in zone 66*b* is to continue playing on a fairway grade pitching hole assigned to that hole. The intermediate ring 72 is divided into four scoring zones 66*c*, 66*d*, 66*e*, and 66*f*. The scoring zone 66*c* is labeled "sand trap" signifying that a player whose ball lands in zone 66*c* is to continue play on a sand trap hole assigned to that hole. The scoring zone 66*d* is unlabeled, signifying that the player whose ball lands in zone 66*d* is to continue playing on a fairway grade pitching hole assigned to that hole. The scoring zone 66*e* is labeled "deep rough" signifying that a player whose ball lands in zone 66*e* is to continue playing on a deep rough grade pitching hole assigned to that hole. The scoring zone 66*f* is unlabeled, signifying that the player whose ball lands in zone 66*f* is to continue play on a fairway grade pitching hole assigned to that hole. The outer ring 74 is divided into four scoring zones 66*g*, 66*h*, 66*i*, and 66*j*. The scoring zone 66*g* is labeled "sand trap" signifying that the player whose ball lands in zone 66*g* is to continue playing on a sand trap hole. The scoring zone 66*h* is unlabeled, signifying that the player whose ball lands in zone 66*h* is to continue play on a fairway grade pitching hole. The scoring zone 66*i* is labeled "deep rough" signifying that the player whose ball lands in zone 66*i* is to continue playing on a deep rough grade pitching hole. The scoring zone 66*j* is unlabeled, signifying that the player whose ball lands in zone 66*j* is to continue playing on a fairway grade pitching hole. There is a scoring zone 66*k* outside the ring 74, and a player whose ball lands in zone 66*k* is to continue playing on a deep rough grade pitching hole.

Figure 8:
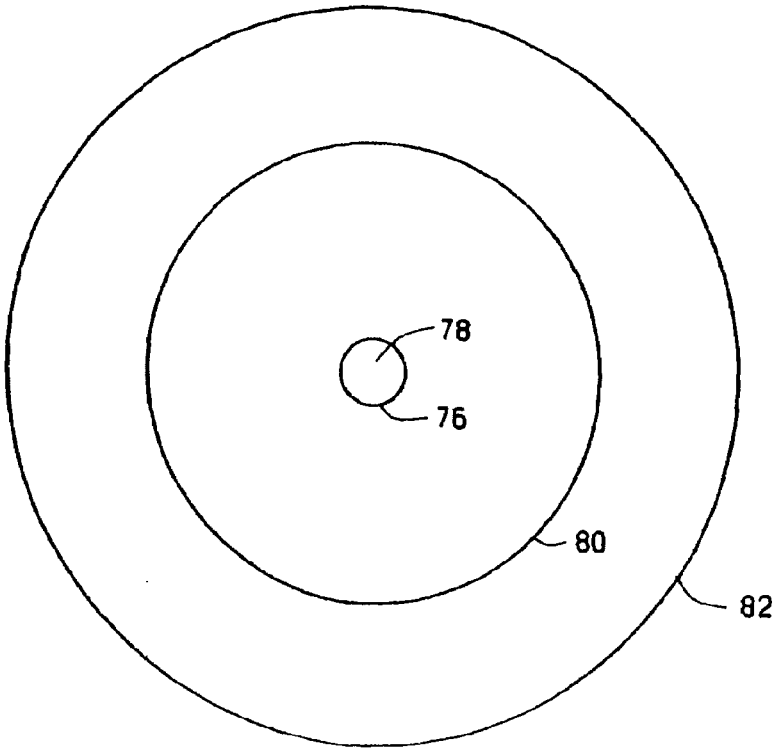
FIG. 8 is a top plan view of a target for chipping and sand trap holes.

The target 60, as shown in FIG. 8, comprises a cup 76, having a flag 78 therein, and surrounded by scoring zones, in this case two concentric rings 80 and 82. Where a player's ball lands on the target 60 determines continued play or scoring. Where play is to continue on a pitching hole, as described below, then where the ball lands determines what type of pitching shot will be played. If the ball lands inside ring 80, play continues on a fairway grade pitching hole; if the ball lands outside ring 80, but inside ring 82, the play continues on a rough-grade pitching hole; and if the ball lands outside the rings 80 and 82, then play continues on a deep rough grade pitching hole. Where play is to continue on a putting hole, as described below, then where the ball lands determines what length or difficulty of putting hole will be played. If the ball lands inside ring 80, then play continues on a short putting hole or a short start on a putting hole; if the ball lands outside ring 80, but inside ring 82, then play continues on an intermediate putting hole or an intermediate start on a putting hole; and, if the ball lands outside the rings 80 and 82, then play continues on a long putting hole or a long start on a putting hole. Where play does not continue on another hole, then where the ball lands determines scoring. If a player's ball lands inside ring 80, then one stroke is added to the score; if a player's ball lands outside ring 80 but inside the ring 82, then two strokes are added to the score; and if the player's ball lands outside the rings 80 and 82, then three strokes are added to the score.

There are a plurality of tee boxes 84 along the left side 32 of the second and third floors 42 and 44 adjacent to the dome 24, from which players can hit balls onto the targets 58 in the dome. Similarly, there are a plurality of tee boxes 84 along the right side 34 of each of the floors 40, 42, and 44, adjacent the dome 26, from which players can hit balls onto the targets 58 in the dome. As explained below, there are no tee boxes 84 on the left side 32 of the first floor 40. The tee boxes on the right side 34 of the first floor 40 are each assigned to a particular target 58 in one of the rows 52, 54 or 56 in the domed section 26. The tee boxes 84 on the left side 32 of the second floor 42 are each assigned to a particular target 58 in rows 48 or 50 in the domed section 24, and the tee boxes 84 on the right side 34 of the second floor 42 are each assigned to a particular target 58 in one of the rows 52, 54, or 56 in the domed section 26. The tee boxes 84 on the left side 32 of the third floor 44 are each assigned to a particular target 58 in row 48 or row 50, and tee boxes 84 on the right side 34 of the third floor 44 are each assigned to a particular target 58 in rows 52, 54 or 56 in the domed section 26. A target 58 may have more than one tee box assigned to it.

Each tee box 84 preferably has a turf surface on which a golf ball can be placed to hit toward the target 58 assigned to that tee box. This turf can be natural or artificial. There are preferably several tee boxes assigned to each target 58. The length of the turf varies among the various tee boxes 84 assigned to each target 58, so the same target can be played under different conditions, for example short turf for a fairway grade shot, medium turf for a rough grade shot, and high turf for a deep rough grade shot. Alternatively each tee box can be provided with sections with different lengths of turf, so that different grades of shots can be played from the same tee box to facilitate playing in groups. There is preferably a rack 86 with golf balls in at least four different colors (to accommodate play in foursomes) associated with each tee box 84, so that each player can play with a different colored ball. The colors can vary from each group of tee boxes so that stray balls from adjacent groups can be readily distinguished.

There is preferably a trough 88, filled with sand, along a portion of the left side 32 of each of the floors 40, 42, and 44 of 35 the central section 22. The trough 88 is a starting place for sand trap shots. The trough 88 on each level is preferably located in a different position along the left side 32. The trough 88 on each of the floors 40, 42, and 44 is associated with one of the targets 60 in the first row 46 of targets inside the domed section 24. The trough 88 on the first floor 40 is located adjacent the back 30, for hitting targets 60 on the section 46*a*. The trough 88 on the second floor 42 is located in between the front 28 and the back 30, for hitting balls at the targets 60 on the section 46*b*, generally in the center of the domed section 24. The trough 88 on the third floor 44 is located adjacent the front 28, for hitting balls at the targets 60 on the section 46*c* in the domed section 24.

A closed circuit television system can be provided with cameras on the various targets 58 and 60, and monitors visible from the tee boxes 84 and troughs 88 so that players can accurately score their shots in the various scoring zones 66 comprising the target 58, and in the various rings comprising the target 60. Alternatively, some form of tracking system, such as an electronic tracking system, could be provided to help players locate and score their shots.

There is preferably a chipping area 90 and a putting area 92 in the center of each of the floors 40, 42, and 44, between the lines of tee boxes 84 on each side. The chipping area 90 and the putting area 92 are separated from the lines of tee boxes 84 by left and right aisles 96L and 96R. Safety lines 98 are provided on the floor to separate the aisles from the tee boxes 72.

The chipping area 90 comprises a plurality of chipping holes 94, each comprising a target 60, described above. Each chipping hole 94 includes one or more tee boxes 100 associated with it, on which a player can place a ball to chip it toward the cup 76 in the appropriate target 60.

The putting area 92 comprises plurality of putting holes 102, each comprising a putting surface 104 having a cup 106 with a removable flag 108. The putting surfaces 104 simulate the surface of a golf course putting green. The putting holes 102 can be different lengths, but preferably the putting holes have multiple starting points 110 at varying distances from the cup so that players can play short, medium, and long putts on the same putting hole. For example a hole 102 might have a starting point 110*a* a maximum of 15 feet from the cup 106 for a short putt, a starting point 110*b* about 10 to 25 feet from the cup 106 for a medium putt, and a starting point 110*c* about 25 to 50 feet from the cup 106 for a long putt. The putting surfaces 104 may be natural or artificial turf. The putting area 92 can be suitably landscaped with turf and plants.

The facility enables play on three distinct types of short shot holes: pitching holes, which are played from the tee boxes 84 toward the appropriate target 58 in one of the rows in the domed sections 24 and 26; sand trap holes, which are played from the troughs 88 toward the appropriate targets 60 in the first row 46 in the domed section 24; and chipping holes, which are played on the chipping holes 94 in the chipping area 90. There is further differentiation among these hole types. The pitching holes can be played from tee boxes with short, intermediate, or tall turf to simulate fairway, rough, and deep rough conditions (or each tee box can have these different turfs). Similarly, the chipping holes 94 can have varying lengths, and their tee boxes 100 can also have differing turfs to simulate chipping from the apron of the green, the fairway, or the rough.

A "virtual" golf hole can be created from one or more short shot holes, a putting hole, or a combination of one or more short shot holes and a putting hole, to achieve a par of one through five.

Par One Virtual Holes

A par one virtual hole could be played on a short putting hole 102 (i.e., a hole with an overall length of less than about 15 feet) or on a putting hole 102 with a short starting point 110*a*. The player places the ball on the putting surface 104 and putts continuing play until holing out by putting the ball into the cup 106. The score for the virtual hole would simply be the number of strokes taken to putt the ball into the cup 106.

CHART OF POSSIBLE PAR 1 VIRTUAL HOLES

| HOLE TYPE | START | SECOND START | THIRD START | FINISH |
|---|---|---|---|---|
| SHORT PUTT Par 1 | short putting hole 102 or short start 110a on a putting hole 102 | | | |

Par Two Virtual Holes

A par two virtual hole could be played on an intermediate putting hole 102 (i.e., a hole with an overall length between 10 and 25 feet) or on a putting hole 102 with an intermediate starting point 110*b*. The player places the ball on the putting surface 104 and putts, continuing play until holing out by putting the ball into the cup 106. The score for the virtual hole would simply be the number of strokes taken to putt the ball into the cup.

A par two virtual hole could also be played on a very short (maximum 25 feet) short shot hole, for example a chipping hole 94. The player would place the ball on the appropriate tee box 100, and hit the ball toward the appropriate target 60. The scoring rings 80 and 82 on the target 60 indicate a number of strokes (one or two) to add to the initial stroke to determine the score for the virtual hole. For example, if a player's ball lands within the ring 80, one stroke would be added to the player's score; if the ball landed outside the ring 80, but inside the ring 82, two strokes would be added to the player's score; and if the ball lands outside both rings 80 and 82 three strokes would be added to the player's score.

CHART OF POSSIBLE PAR 2 VIRTUAL HOLES

| HOLE TYPE | START | SECOND START | THIRD START | FINISH |
|---|---|---|---|---|
| MEDIUM PUTT Par 2 | intermediate putting hole 102 or intermediate start 110b on a putting hole 102 | | | |

-continued

CHART OF POSSIBLE PAR 2 VIRTUAL HOLES

| HOLE TYPE | START | SECOND START | THIRD START | FINISH |
|---|---|---|---|---|
| SHORT CHIPPING Par 2 | the box 100 for chipping hole 94 | | | add strokes |

Par 3 Virtual Holes

A par three virtual hole could simply be played on a long putting hole 102 (i.e., a hole with an overall length between 25 and 50 feet) or on a putting 102 with a long starting point 110*c*. The player places the ball on the putting surface 104 and putts, continuing play until holing out by putting the ball into the cup 106. The score for the virtual hole could simply be the number of strokes taken to putt the ball into the cup 106.

A par three virtual hole could also be played on a pitching hole, a chipping hole, or a sand trap hole. The player would place the ball on the appropriate tee box 84 and hit the ball toward the corresponding target 58, or on the appropriate tee box 100 and hit the ball toward the appropriate target 60 in the chipping area 90, or in the trough 88 and hit the ball toward the appropriate target 60 in the first row 46 in the domed section 24. Where the ball lands determines further play. On a par 3 hole, if the ball lands inside the inner ring 70 of target 58 or inside the inner ring 80 of target 60, then play continues on a short putting hole 102 or on a putting hole 102 with a short starting point 110*a* (or for shorter games one stroke can be added to the player's score); if the ball lands inside the intermediate ring 72 or the outer ring 74 of target 58 or inside the outer ring 82 of the target 60, then play continues on an intermediate putting hole 102 or on a putting hole 102 with an intermediate starting point 110*b* (or for shorter games two strokes can be added to the player's score); and if the ball lands outside the outer ring 74 of target 58, or outside the outer ring 82 of target 60, then play continues on a long putting hole 102 or on a putting hole 102 with a long starting point 110*c* (or for shorter games three strokes can be added to the player's score). The player resumes play on the appropriate putting hole 102 at the appropriate starting point corresponding to where on the target 58 or 60 the first ball landed. The score for the virtual hole is the total number of strokes taken.

CHART OF POSSIBLE PAR 3 VIRTUAL HOLES

| HOLE TYPE | START | SECOND START | THIRD START | FINISH |
|---|---|---|---|---|
| LONG PUTT Par 3 | long putting hole 102 or long start 110c on a putting hole 102 | | | |
| PITCHING Par 3 | tee box 84 for a pitching hole | | | add strokes |
| PITCHING Par 3 | tee box 84 for a pitching hole | | | short putting hole 102 or short start 110a on a putting hole 102 |
| PITCHING Par 3 | tee box 84 for a pitching hole | | | intermediate putting hole 102 or intermediate start 110b on a putting hole 102 |
| PITCHING Par 3 | tee box 84 for a pitching hole | | | long putting hole 102 or long start 110c on a putting hole 102 |
| CHIPPING Par 3 | tee box 102 for a chipping hole 94 | | | add strokes |
| CHIPPING Par 3 | tee box 102 for a chipping hole 94 | | | short putting hole 102 or short start 110a on a putting hole 102 |
| CHIPPING Par 3 | tee box 102 for a chipping hole 94 | | | intermediate putting hole 102 or intermediate start 110b on a putting hole 102 |
| CHIPPING Par 3 | tee box 102 for a chipping hole 94 | | | long putting hole 102 or long start 110c on a putting hole 102 |
| SAND TRAP Par 3 | trough 88 for a sand trap hole | | | add strokes |
| SAND TRAP Par 3 | trough 88 for a sand trap hole | | | short putting hole 102 or short start 110a on a putting hole 102 |
| SAND TRAP Par 3 | trough 88 for a sand trap hole | | | intermediate putting hole 102 or intermediate start 110b on a putting hole 102 |
| SAND TRAP Par 3 | trough 88 for a sand trap hole | | | long putting hole 102 or long start 110c on a putting hole 102 |

Par 4 Virtual Holes

A par four virtual hole could be played on a pitching hole with a second non-putting shot. A player places the ball on the appropriate tee box 84, and hits the ball toward the appropriate target 58. Where the ball lands determines further play. If the ball lands in scoring zone 66*a*, then play continues with a chip shot on a chipping hole 94; if the ball lands in a scoring zones 66*c* or 66*g*, then play continues with a sand shot from the trough 88; if the ball lands in a scoring zone 66*e* or 66*i*, then play continues with a pitching shot from one of the tee boxes 84 with long turf, simulating a deep rough shot; if the ball lands elsewhere on the target 58, then play continues on a fairway grade pitch shot hole assigned to the hole; if the ball lands outside the target 58 play continues on a rough grade pitch shot (i.e. from a tee box 84 with medium length turf). Various hazards zones can be provided around the targets 58, and if a ball lands in one of these hazard zones, then play continues on a deep rough grade pitch shot hole (i.e., from a tee box 84 with long turf) or a sand trap hole, as designated. Play continues on a chipping hole, a sand trap hole, or another pitching hole as determined by the first shot of the player.

The player places the ball on the tee box 100 of the chipping hole 94, the trough 88 of the sand trap hole, or the tee box 84 of the pitching hole, and continues play. On a subsequent chipping hole, the player places the ball on the appropriate tee box 100, and hits the ball toward the appropriate target 60. Where the ball lands determines further play. If play is to continue on a putting hole, the player resumes play on the appropriate putting hole 102 at the appropriate starting point corresponding to where on the target 60 the second ball lands. If play does not continue on a putting hole, the scoring zones 80 and 82 on the target 60 indicate a number of strokes (one, two, or three) to add to determine the score for the virtual hole. For example if the ball lands inside the inner ring 80, one stroke would be added to the player's score; if the ball lands outside the ring 80, but inside ring 82, two strokes would be added to the player's score and, if the ball lands outside both rings 80 and 82, three strokes would be added to the player's score.

On a subsequent pitching hole, the player places the ball on the appropriate tee box 84, and hits the ball toward the appropriate target 58. If play is to continue on a putting hole, when the ball lands inside the inner ring 70 of target 58, then play continues on a short putting hole 102 or on a putting hole 102 with a short starting point 110*a* (or for shorter games one stroke can be added to the player's score); if the ball lands outside ring 70 but inside the intermediate ring 72 or the outer ring 74 of target 58, then play continues on an intermediate putting hole 102 or on a putting hole 102 with an intermediate starting point 110*b* (or for shorter games two strokes can be added to the player's score); and if the ball lands outside the outer ring 74 of target 58, then play continues on a long putting hole 102 or on a putting hole 102 with an long starting point 110*c* (or for shorter games three strokes can be added to the player's score). The player resumes play on the appropriate putting hole 102 corresponding to where on the target 58 the second ball lands.

On a subsequent sand trap hole, the player places the ball in the trough 88, and hits the ball toward the appropriate target 60. Where the ball lands determines further play. If play is to continue on a putting hole, the player resumes play on the appropriate putting hole 102 at the appropriate starting point corresponding to where on the target 60 the second ball lands. If play does not continue on a putting hole, the scoring zones 80 and 82 on the target 60 indicate a number of strokes (one, two, or three) to add to determine the score for the virtual hole. For example if the ball lands inside the inner ring 80, one stroke would be added to the player's score; if the ball lands outside the ring 80, but inside ring 82, two strokes would be added to the player's score; and, if the ball lands outside both rings 80 and 82, three strokes would be added to the player's score.

A par four virtual hole could also be played on a chipping hole 94 with a second non-putting shot. Although the second non-putting shot could be either a pitch shot, a chip shot, or a sand trap shot, for simplicity in the preferred embodiment the second shot is standardized as a pitch shot. A player places the ball on the appropriate tee box 100, and hits the ball toward the appropriate target 60. For the subsequent pitching hole shot, play continues on the appropriate tee box 84. Where the ball lands in the rings 80 and 82 of the target 60 determines the type of shot on the assigned pitch shot hole. For example, if the ball lands inside the ring 80, then play continues on short turf on the tee box 84, simulating a fairway grade shot; if the ball lands outside ring 80 but inside ring 82, then play continues on medium turf on the tee box, simulating a rough grade shot; and, if the ball lands outside the ring 82, then play continues on high turf, simulating a deep rough shot. On the subsequent pitch shot, if the ball lands inside the inner ring 70 of target 58, then play continues on a short putting hole 102 or on a putting hole 102 with a short starting point 110*a* (or for shorter games one stroke can be added to the player's score); if the ball lands inside the intermediate ring 72 or the outer ring 74 of target 58, then play continues on an intermediate putting hole 102 or on a putting hole 102 with an intermediate starting point 110*b* (or for shorter games two strokes can be added to the players score); and if the ball lands outside the outer ring 74 of target 58, then play continues on a long putting hole 102 or on a putting hole 102 with an long starting point 110*c* (or for shorter games three strokes can be added to the player's score). The player resumes play on the appropriate putting hole 102 corresponding to where on the target 58 the second ball lands. Of course, some arrangement could be made to continue play on a chipping hole 94 or a sand trap hole, if desired.

A par four virtual hole could be played on a sand trap hole with a second non-putting shot. Although the second non-putting shot could be either a pitch shot, a chip shot, or a sand trap shot, for simplicity in the preferred embodiment the second shot is standardized as a pitch shot. A player places the ball in the appropriate slot in trough 88, and hits the ball toward the appropriate target 60. Where the ball lands in the rings 80 and 82 of the target 60 determines the type of shot on the assigned pitch shot hole. For example, if the ball lands inside the ring 80, then play continues on short turf on the tee box 84, simulating a fairway grade shot; if the ball lands outside ring 80 but inside ring 82, then play continues on medium turf on the tee box, simulating a rough grade shot; and, if the ball lands outside the ring 82, then play continues on high turf, simulating a deep rough shot. For the subsequent pitching hole slot, play continues on the appropriate tee box 84. If the ball lands inside the inner ring 70 of target 58, then play continues on a short putting hole 102 or on a putting hole 102 with a short starting point 110*a* (or for shorter games one stroke can be added to the player's score); if the ball lands inside the intermediate ring 72 or the outer ring 74 of target 58, then play continues on an intermediate putting hole 102 or on a putting hole 102 with in intermediate starting point 110*b* (or for shorter games two stokes can be added to the player's score); and if the ball lands outside the outer ring 74 of target 58, then play continues on a long putting hole 102 or on a putting hole 102 with an long starting point 110*c* (or for shorter games three strokes can be added to the player's score). The player resumes play on the appropriate putting hole 102 corresponding to where on the target 58 the second ball lands. Of course, some arrangement could be made to continue play on a chipping hole 94 or a sand trap hole, if desired.

CHART OF POSSIBLE PAR 4 VIRTUAL HOLES

| HOLE TYPE | START | SECOND START | THIRD START | FINISH |
|---|---|---|---|---|
| PITCHING WITH SECOND SHOT Par 4 | tee box 84 for a pitching hole | tee box 84 for a pitching hole | | add strokes |

-continued

CHART OF POSSIBLE PAR 4 VIRTUAL HOLES

| HOLE TYPE | START | SECOND START | THIRD START | FINISH |
|---|---|---|---|---|
| PITCHING WITH SECOND SHOT Par 4 | tee box 84 for a pitching hole | tee box 84 for a pitching hole | | short putting hole 102 or short start 110a on a putting hole 102 |
| PITCHING WITH SECOND SHOT Par 4 | tee box 84 for a pitching hole | tee box 84 for a pitching hole | | intermediate putting hole 102 or intermediate start 110b on a putting hole 102 |
| PITCHING WITH SECOND SHOT Par 4 | tee box 84 for a pitching hole | tee box 84 for a pitching hole | | long putting hole 102 or long start 110c on a putting hole 102 |
| PITCHING WITH SECOND SHOT Par 4 | tee box 84 for a pitching hole | trough 88 for a sand trap hole | | add strokes |
| PITCHING WITH SECOND SHOT Par 4 | tee box 84 for a pitching hole | trough 88 for a sand trap hole | | short putting hole 102 or short start 110a on a putting hole 102 |
| PITCHING WITH SECOND SHOT Par 4 | tee box 84 for a pitching hole | trough 88 for a sand trap hole | | intermediate putting hole 102 or intermediate start 110b on a putting hole 102 |
| PITCHING WITH SECOND SHOT Par 4 | tee box 84 for a pitching hole | trough 88 for a sand trap hole | | long putting hole 102 or long start 110c on a putting hole 102 |
| PITCHING WITH SECOND SHOT Par 4 | tee box 84 for a pitching hole | tee box 100 for a chipping hole 94 | | add strokes |
| PITCHING WITH SECOND SHOT Par 4 | tee box 84 for a pitching hole | tee box 100 for a chipping hole 94 | | short putting hole 102 or short start 110a on a putting hole 102 |
| PITCHING WITH SECOND SHOT Par 4 | tee box 84 for a pitching hole | tee box 100 for a chipping hole 94 | | intermediate putting hole 102 or intermediate start 110b on a putting hole 102 |
| PITCHING WITH SECOND SHOT Par 4 | tee box 84 for a pitching hole | tee box 100 for a chipping hole 94 | | long putting hole 102 or long start 110c on a putting hole 102 |
| CHIPPING WITH SECOND SHOT Par 4 | tee box 100 for a chipping hole 94 | tee box 84 for a pitching hole | | add strokes |
| CHIPPING WITH SECOND SHOT Par 4 | tee box 100 for a chipping hole 94 | tee box 84 for a pitching shot | | short putting hole 102 or short start 110a on a putting hole 102 |
| CHIPPING WITH SECOND SHOT Par 4 | tee box 100 for a chipping hole 94 | tee box 84 for a pitching shot | | intermediate putting hole 102 or intermediate start 110b on a putting hole 102 |
| CHIPPING WITH SECOND SHOT Par 4 | tee box 100 for a chipping hole 94 | tee box 84 for a pitching shot | | long putting hole 102 or long start 110c on a putting hole 102 |
| CHIPPING* WITH SECOND SHOT Par 4 | tee box 100 for a chipping hole 94 | trough 88 for a sand trap hole | | add strokes |
| CHIPPING* WITH SECOND SHOT Par 4 | tee box 100 for a chipping hole 94 | trough 88 for a sand trap hole | | short putting hole 102 or short start 110a on a putting hole 102 |
| CHIPPING* WITH SECOND | tee box 100 for a chipping hole | trough 88 for a sand trap hole | | intermediate putting hole 102 |

-continued

CHART OF POSSIBLE PAR 4 VIRTUAL HOLES

| HOLE TYPE | START | SECOND START | THIRD START | FINISH |
|---|---|---|---|---|
| SHOT Par 4 | 94 | | | or intermediate start 110b on a putting hole 102 |
| CHIPPING* WITH SECOND SHOT Par 4 | tee box 100 for a chipping hole 94 | trough 88 for a sand trap hole | | long putting hole 102 or long start 110c on a putting hole 102 |
| CHIPPING* WITH SECOND SHOT Par 4 | tee box 100 for a chipping hole 94 | tee box 100 for a chipping hole 94 | | add strokes |
| CHIPPING* WITH SECOND SHOT Par 4 | tee box 100 for a chipping hole 94 | tee box 100 for a chipping hole 94 | | short putting hole 102 or short start 110a on a putting hole 102 |
| CHIPPING* WITH SECOND SHOT Par 4 | tee box 100 for a chipping hole 94 | tee box 100 for a chipping hole 94 | | intermediate putting hole 102 or intermediate start 110b on a putting hole 102 |
| CHIPPING* WITH SECOND SHOT Par 4 | tee box 100 for a chipping hole 94 | tee box 100 for a chipping hole 94 | | long putting hole 102 or long start 110c on a putting hole 102 |
| SAND TRAP* WITH SECOND SHOT Par 4 | trough 88 for a sand trap hole | tee box 100 for a chipping hole 94 | | add strokes |
| SAND TRAP* WITH SECOND SHOT Par 4 | trough 88 for a sand trap hole | tee box 100 for a chipping hole 94 | | short putting hole 102 or short start 110a on a putting hole 102 |
| SAND TRAP* WITH SECOND SHOT Par 4 | trough 88 for a sand trap hole | tee box 100 for a chipping hole 94 | | intermediate putting hole 102 or intermediate start 110b on a putting hole 102 |
| SAND TRAP* WITH SECOND SHOT Par 4 | trough 88 for a sand trap hole | tee box 100 for a chipping hole 94 | | long putting hole 102 or long start 110c on a putting hole 102 |
| SAND TRAP* WITH SECOND SHOT Par 4 | trough 88 for a sand trap hole | trough 88 for a sand trap hole | | add strokes |
| SAND TRAP* WITH SECOND SHOT Par 4 | trough 88 for a sand trap hole | trough 88 for a sand trap hole | | short putting hole 102 or shot start 110a on a putting hole 102 |
| SAND TRAP* WITH SECOND SHOT Par 4 | trough 88 for a sand trap hole | trough 88 for a sand trap hole | | intermediate putting hole 102 or intermediate start 110b on a putting hole 102 |
| SAND TRAP* WITH SECOND SHOT Par 4 | trough 88 for a sand trap hole | trough 88 for a sand trap hole | | long putting hole 102 or long start 110c on a putting hole 102 |
| SAND TRAP WITH SECOND SHOT Par 4 | trough 88 for a sand trap hole | tee box 84 for a pitching hole | | add strokes |
| SAND TRAP WITH SECOND SHOT Par 4 | trough 88 for a sand trap hole | tee box 84 for a pitching hole | | short putting hole 102 or short start 110a on a putting hole 102 |
| SAND TRAP WITH SECOND SHOT Par 4 | trough 88 for a sand trap hole | tee box 84 for a pitching hole | | intermediate putting hole 102 or intermediate start 110b on a putting hole 102 |

-continued

CHART OF POSSIBLE PAR 4 VIRTUAL HOLES

| HOLE TYPE | START | SECOND START | THIRD START | FINISH |
|---|---|---|---|---|
| SAND TRAP WITH SECOND SHOT Par 4 | trough 88 for a sand trap hole | tee box 84 for a pitching hole | | long putting hole 102 or long start 110c on a putting hole 102 |

*The hole types marked with an (*) are possible combinations that are not preferred, it being preferable that second shots on chipping holes and sand trap holes always be on pitching holes.

Par Five Virtual Hole

A par five virtual hole could be played on a pitching hole with a second and third non-putting shot. A player places the ball on the appropriate tee box 84, and hits the ball toward the appropriate target 58. Where the ball lands determines further play. If the ball lands in scoring zone 66*a*, then play continues with a chip shot on a chipping hole 94; if the ball lands in a scoring zones 66*c* or 66*g*, then play continues with a sand shot from the trough 88; if the ball lands in a scoring zone 66*e* or 66*i* then play continues with a pitching shot from one of the tee boxes 84 with long turf, simulating a deep rough shot; and if the ball lands elsewhere on the target 58, the play continues with a pitching shot from one of the tee boxes 84 with fairway turf, simulating a fairway shot. If the ball lands outside the target 58 then play continues from one of the tee boxes 84 with long turf, simulating a deep rough shot. Play continues on a chipping hole 94, a sand trap hole, or another pitching hole as determined by the player's first shot. Other par five virtual holes could be played starting on chipping holes and sand trap holes, with second and third non-putting shots.

Thereafter, play would continue as for the par four virtual holes described above.

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| PITCHING WITH SECOND AND THIRD SHOTS | tee box 84 for a pitching hole | tee box 84 for a pitching hole | tee box 84 for a pitching hole | add strokes |
| PITCHING WITH SECOND AND THIRD SHOTS | tee box 84 for a pitching hole | tee box 84 for a pitching hole | tee box 84 for a pitching hole | short putting hole 102 or short start 110a on a putting hole 102 |
| PITCHING WITH SECOND AND THIRD SHOTS | tee box 84 for a pitching hole | tee box 84 for a pitching hole | tee box 84 for a pitching hole | intermediate putting hole 102 or intermediate start 110b on a putting hole 102 |
| PITCHING WITH SECOND AND THIRD SHOTS | tee box 84 for a pitching hole | tee box 84 for a pitching hole | tee box 84 for a pitching hole | long putting hole 102 or long start 110c on a putting hole 102 |
| PITCHING WITH SECOND AND THIRD SHOTS | tee box 84 for a pitching hole | tee box 84 for a pitching hole | trough 88 for a sand trap hole | add strokes |
| PITCHING WITH SECOND AND THIRD SHOTS | tee box 84 for a pitching hole | tee box 84 for a pitching hole | trough 88 for a sand trap hole | short putting hole 102 or short start 110a on a putting hole 102 |
| PITCHING WITH SECOND AND THIRD SHOTS | tee box 84 for a pitching hole | tee box 84 for a pitching hole | trough 88 for a sand trap hole | intermediate putting hole 102 or intermediate start 110b on a putting hole 102 |
| PITCHING WITH SECOND AND THIRD SHOTS | tee box 84 for a pitching hole | tee box 84 for a pitching hole | trough 88 for a sand trap hole | long putting hole 102 or long start 110c on a putting hole 102 |
| PITCHING WITH SECOND AND THIRD SHOTS | tee box 84 for a pitching hole | tee box 84 for a pitching hole | tee box 100 for a chipping hole 94 | add strokes |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| PITCHING WITH SECOND AND THIRD SHOTS | tee box 84 for a pitching hole | tee box 84 for a pitching hole | tee box 100 for a chipping hole 94 | short putting hole 102 or short start 110a on a putting hole 102 |
| PITCHING WITH SECOND AND THIRD SHOTS | tee box 84 for a pitching hole | tee box 84 for a pitching hole | tee box 100 for a chipping hole 94 | intermediate putting hole 102 or intermediate start 110b on a putting hole 102 |
| PITCHING WITH SECOND AND THIRD SHOTS | tee box 84 for a pitching hole | tee box 84 for a pitching hole | tee box 100 for a chipping hole 94 | long putting hole 102 or long start 110c on a putting hole 102 |
| PITCHING WITH SECOND AND THIRD SHOTS | tee box 84 for a pitching hole | trough 88 for a sand trap hole | tee box 84 for a pitching hole 72 | add strokes |
| PITCHING WITH SECOND AND THIRD SHOTS | tee box 84 for a pitching hole | trough 88 for a sand trap hole | tee box 84 for a pitching hole 72 | short putting hole 102 or short start 110a on a putting hole 102 |
| PITCHING WITH SECOND AND THIRD SHOTS | tee box 84 for a pitching hole | trough 88 for a sand trap hole | tee box 84 for a pitching hole | intermediate putting hole 102 or intermediate start 110b on a putting hole 102 |
| PITCHING WITH SECOND AND THIRD SHOTS | tee box 84 for a pitching hole | trough 88 for a sand trap hole | tee box 84 for a pitching hole | long putting hole 102 or long start 110c on a putting hole 102 |
| PITCHING* WITH SECOND AND THIRD SHOTS | tee box 84 for a pitching hole | trough 88 for a sand trap hole | trough 88 for a sand trap hole | add strokes |
| PITCHING* WITH SECOND AND THIRD SHOTS | tee box 84 for a pitching hole | trough 88 for a sand trap hole | trough 88 for a sand trap hole | short putting hole 102 or short start 110a on a putting hole 102 |
| PITCHING* WITH SECOND AND THIRD SHOTS | tee box 84 for a pitching hole | trough 88 for a sand trap hole | trough 88 for a sand trap hole | intermediate putting hole 102 or intermediate start 110b on a putting hole 102 |
| PITCHING* WITH SECOND AND THIRD SHOTS | tee box 84 for a pitching hole | trough 88 for a sand trap hole | trough 88 for a sand trap hole | long putting hole 102 or long start 110c on a putting hole 102 |
| PITCHING* WITH SECOND AND THIRD SHOTS | tee box 84 for a pitching hole | trough 88 for a sand trap hole | tee box 100 for a chipping hole 94 | add strokes |
| PITCHING* WITH SECOND AND THIRD SHOTS | tee box 84 for a pitching hole | trough 88 for a sand trap hole | tee box 100 for a chipping hole 94 | short putting hole 102 or short start 110a on a putting hole 102 |
| PITCHING* WITH SECOND AND THIRD SHOTS | tee box 84 for a pitching hole | trough 88 for a sand trap hole | tee box 100 for a chipping hole 94 | intermediate putting hole 102 or intermediate start 110b on a putting hole 102 |
| PITCHING* WITH SECOND AND THIRD SHOTS | tee box 84 for a pitching hole | trough 88 for a sand trap hole | tee box 100 for a chipping hole 94 | long putting hole 102 or long start 110c on a putting hole 102 |
| PITCHING WITH SECOND AND THIRD SHOTS | tee box 84 for a pitching hole | tee box 100 for a chipping hole 94 | tee box 84 for a pitching hole | add strokes |
| PITCHING WITH SECOND AND THIRD SHOTS | tee box 84 for a pitching hole | tee box 100 for a chipping hole 94 | tee box 84 for a pitching hole | short putting hole 102 or short start 110a on a putting hole 102 |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| PITCHING WITH SECOND AND THIRD SHOTS | tee box 84 for a pitching hole | tee box 100 for a chipping hole 94 | tee box 84 for a pitching hole | intermediate putting hole 102 or intermediate start 110b on a putting hole 102 |
| PITCHING WITH SECOND AND THIRD SHOTS | tee box 84 for a pitching hole | tee box 100 for a chipping hole 94 | tee box 84 for a pitching hole | long putting hole 102 or long start 110c on a putting hole 102 |
| PITCHING WITH SECOND AND THIRD SHOTS | tee box 84 for a pitching hole | tee box 100 for a chipping hole 94 | trough 88 for a sand trap hole | add strokes |
| PITCHING* WITH SECOND AND THIRD SHOTS | tee box 84 for a pitching hole | tee box 100 for a chipping hole 94 | trough 88 for a sand trap hole | short putting hole 102 or short start 110a on a putting hole 102 |
| PITCHING* WITH SECOND AND THIRD SHOTS | tee box 84 for a pitching hole | tee box 100 for a chipping hole 94 | trough 88 for a sand trap hole | intermediate putting hole 102 or intermediate start 110b on a putting hole 102 |
| PITCHING* WITH SECOND AND THIRD SHOTS | tee box 84 for a pitching hole | tee box 100 for a chipping hole 94 | trough 88 for a sand trap hole | long putting hole 102 or long start 110c on a putting hole 102 |
| PITCHING WITH SECOND AND THIRD SHOTS | tee box 84 for a pitching hole | tee box 100 for a chipping hole 94 | tee box 100 for a chipping hole 94 | add strokes |
| PITCHING* WITH SECOND AND THIRD SHOTS | tee box 84 for a pitching hole | tee box 100 for a chipping hole 94 | tee box 100 for a chipping hole 94 | short putting hole 102 or short start 110a on a putting hole 102 |
| PITCHING* WITH SECOND AND THIRD SHOTS | tee box 84 for a pitching hole | tee box 100 for a chipping hole 94 | tee box 100 for a chipping hole 94 | intermediate putting hole 102 or intermediate start 110b on a putting hole 102 |
| PITCHING* WITH SECOND AND THIRD SHOTS | tee box 84 for a pitching hole | tee box 100 for a chipping hole | tee box 100 for a chipping hole 94 | long putting hole 102 or long start 110c on a putting hole 102 |
| CHIPPING WITH SECOND AND THIRD SHOTS | tee box 100 for a chipping hole 94 | tee box 84 for a pitching hole | tee box 84 for a pitching hole | add strokes |
| CHIPPING WITH SECOND AND THIRD SHOTS | tee box 100 for a chipping hole 94 | tee box 84 for a pitching hole | tee box 84 for a pitching hole | short putting hole 102 or short start 110a on a putting hole 102 |
| CHIPPING WITH SECOND AND THIRD SHOTS | tee box 100 for a chipping hole 94 | tee box 84 for a pitching hole | tee box 84 for a pitching hole | intermediate putting hole 102 or intermediate start 110b on a putting hole 102 |
| CHIPPING WITH SECOND AND THIRD SHOTS | tee box 100 for a chipping hole 94 | tee box 84 for a pitching hole | tee box 84 for a pitching hole | long putting hole 102 or long start 110c on a putting hole 102 |
| CHIPPING WITH SECOND AND THIRD SHOTS | tee box 100 for a chipping hole 94 | tee box 84 for a pitching hole | trough 88 for a sand trap hole | add strokes |
| CHIPPING WITH SECOND AND THIRD SHOTS | tee box 100 for a chipping hole 94 | tee box 84 for a pitching hole | trough 88 for a sand trap hole | short putting hole 102 or short start 110a on a putting hole 102 |
| CHIPPING WITH SECOND AND THIRD SHOTS | tee box 100 for a chipping hole 94 | tee box 84 for a pitching hole | trough 88 for a sand trap hole | intermediate putting hole 102 or intermediate start 110b on a putting hole 102 |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| CHIPPING WITH SECOND AND THIRD SHOTS | tee box 100 for a chipping hole 94 | tee box 84 for a pitching hole | trough 88 for a sand trap hole | long putting hole 102 or long start 110c on putting hole 102 |
| CHIPPING WITH SECOND AND THIRD SHOTS | tee box 100 for a chipping hole 94 | tee box 84 for a pitching hole | tee box 100 for a chipping hole 94 | add strokes |
| CHIPPING WITH SECOND AND THIRD SHOTS | tee box 100 for a chipping hole 94 | tee box 84 for a pitching hole | tee box 100 for a chipping hole 94 | short putting hole 102 or short start 110a on putting hole 102 |
| CHIPPING WITH SECOND AND THIRD SHOTS | tee box 100 for a chipping hole 94 | tee box 84 for a pitching hole | tee box 100 for a chipping hole 94 | intermediate putting hole 102 or intermediate start 110b on a putting hole 102 |
| CHIPPING WITH SECOND AND THIRD SHOTS | tee box 100 for a chipping hole 94 | tee box 84 for a pitching hole | tee box 100 for a chipping hole 94 | long putting hole 102 or long start 110c on putting hole 102 |
| CHIPPING* WITH SECOND AND THIRD SHOTS | tee box 100 for a chipping hole 94 | trough 88 for a sand trap hole | tee box 84 for a pitching hole | add strokes |
| CHIPPING* WITH SECOND AND THIRD SHOTS | tee box 100 for a chipping hole 94 | trough 88 for a sand trap hole | tee box 84 for a pitching hole | short putting hole 102 or short start 110a on putting hole 102 |
| CHIPPING* WITH SECOND AND THIRD SHOTS | tee box 100 for a chipping hole 94 | trough 88 for a sand trap hole | tee box 84 for a pitching hole | intermediate putting hole 102 or intermediate start 110b on a putting hole 102 |
| CHIPPING* WITH SECOND AND THIRD SHOTS | tee box 100 for a chipping hole 94 | trough 88 for a sand trap hole | tee box 84 for a pitching hole | long putting hole 102 or long start 110c on putting hole 102 |
| CHIPPING* WITH SECOND AND THIRD SHOTS | tee box 100 for a chipping hole 94 | trough 88 for a sand trap hole | trough 88 for a sand trap hole | add strokes |
| CHIPPING* WITH SECOND AND THIRD SHOTS | tee box 100 for a chipping hole 94 | trough 88 for a sand trap hole | trough 88 for a sand trap hole | short putting hole 102 or short start 110a on putting hole 102 |
| CHIPPING* WITH SECOND AND THIRD SHOTS | tee box 100 for a chipping hole 94 | trough 88 for a sand trap hole | trough 88 for a sand trap hole | intermediate putting hole 102 or intermediate start 110b on putting hole 102 |
| CHIPPING* WITH SECOND AND THIRD SHOTS | tee box 100 for a chipping hole 94 | trough 88 for a sand trap hole | trough 88 for a sand trap hole | long putting hole 102 or long start 110c on putting hole 102 |
| CHIPPING* WITH SECOND AND THIRD SHOTS | tee box 100 for a chipping hole 94 | trough 88 for a sand trap hole | tee box 100 for a chipping hole 94 | add strokes |
| CHIPPING* WITH SECOND AND THIRD SHOTS | tee box 100 for a chipping hole 94 | trough 88 for a sand trap hole | tee box 100 for a chipping hole 94 | short putting hole 102 or short start 110a on putting hole 102 |
| CHIPPING* WITH SECOND AND THIRD SHOTS | tee box 100 for a chipping hole 94 | trough 88 for a sand trap hole | tee box 100 for a chipping hole 94 | intermediate putting hole 102 or intermediate start 110b on a putting hole 102 |
| CHIPPING* WITH SECOND AND THIRD SHOTS | tee box 100 for a chipping hole 94 | trough 88 for a sand trap hole | tee box 100 for a chipping hole 94 | long putting hole 102 or long start 110c on putting hole 102 |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| CHIPPING* WITH SECOND AND THIRD SHOTS | tee box 100 for a chipping hole 94 | tee box 100 for a chipping hole 94 | tee box 84 for a pitching hole | add strokes |
| CHIPPING* WITH SECOND AND THIRD SHOTS | tee box 100 for a chipping hole 94 | tee box 100 for a chipping hole 94 | tee box 84 for a pitching hole | short putting hole 102 or short start 110a on a putting hole 102 |
| CHIPPING* WITH SECOND AND THIRD SHOTS | tee box 100 for a chipping hole 94 | tee box 100 for a chipping hole 94 | tee box 84 for a pitching hole | intermediate putting hole 102 or intermediate start 110b on a putting hole 102 |
| CHIPPING* WITH SECOND AND THIRD SHOTS | tee box 100 for a chipping hole 94 | tee box 100 for a chipping hole 94 | tee box 84 for a pitching hole | long putting hole 102 or long start 110c on a putting hole 102 |
| CHIPPING* WITH SECOND AND THIRD SHOTS | tee box 100 for a chipping hole 94 | tee box 100 for a chipping hole 94 | trough 88 for a sand trap hole | add strokes |
| CHIPPING* WITH SECOND AND THIRD SHOTS | tee box 100 for a chipping hole 94 | tee box 100 for a chipping hole 94 | trough 88 for a sand trap hole | short putting hole 102 or short start 110a on putting hole 102 |
| CHIPPING* WITH SECOND AND THIRD SHOTS | tee box 100 for a chipping hole 94 | tee box 100 for a chipping hole 94 | trough 88 for a sand trap hole | intermediate putting hole 102 or intermediate start 110b on a putting hole 102 |
| CHIPPING* WITH SECOND AND THIRD SHOTS | tee box 100 for a chipping hole 94 | tee box 100 for a chipping hole 94 | trough 88 for a sand trap hole | long putting hole 102 or long start 110c on a putting hole 102 |
| CHIPPING* WITH SECOND AND THIRD SHOTS | tee box 100 for a chipping hole 94 | tee box 100 for a chipping hole 94 | tee box 100 for a chipping hole 94 | add strokes |
| CHIPPING* WITH SECOND AND THIRD SHOTS | tee box 100 for a chipping hole 94 | tee box 100 for a chipping hole 94 | tee box 100 for a chipping hole 94 | short putting hole 102 or short start 110a on a putting hole 102 |
| CHIPPING* WITH SECOND AND THIRD SHOTS | tee box 100 for a chipping hole 94 | tee box 100 for a chipping hole 94 | tee box 100 for a chipping hole 94 | intermediate putting hole 102 or intermediate start 110b on a putting hole 102 |
| CHIPPING* WITH SECOND AND THIRD SHOTS | tee box 100 for a chipping hole 94 | tee box 100 for a chipping hole 94 | tee box 100 for a chipping hole 94 | long putting hole 102 or long start 110c on a putting hole 102 |
| SAND TRAP WITH SECOND AND THIRD SHOTS | trough 88 for a sand trap hole | tee box 84 for a pitching hole | tee box 84 for a pitching hole | add strokes |
| SAND TRAP WITH SECOND AND THIRD SHOTS | trough 88 for a sand trap hole | tee box 84 for a pitching hole | tee box 84 for a pitching hole | short putting hole 102 or short start 110a on a putting hole 102 |
| SAND TRAP WITH SECOND AND THIRD SHOTS | trough 88 for a sand trap hole | tee box 84 for a pitching hole | tee box 84 for a pitching hole | intermediate putting hole 102 or intermediate start 110b on a putting hole 102 |
| SAND TRAP WITH SECOND AND THIRD SHOTS | trough 88 for a sand trap hole | tee box 84 for a pitching hole | tee box 84 for a pitching hole | long putting hole 102 or long start 110c on a putting hole 102 |
| SAND TRAP WITH SECOND AND THIRD SHOTS | trough 88 for a sand trap hole | tee box 84 for a pitching hole | trough 88 for a sand trap hole | add strokes |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| SAND TRAP WITH SECOND AND THIRD SHOTS | trough 88 for a sand trap hole | tee box 84 for a pitching hole | trough 88 for a sand trap hole | short putting hole 102 or short start 110a on a putting hole 102 |
| SAND TRAP WITH SECOND AND THIRD SHOTS | trough 88 for a sand trap hole | tee box 84 for a pitching hole | trough 88 for a sand trap hole | intermediate putting hole 102 or intermediate start 110b on a putting hole 102 |
| SAND TRAP WITH SECOND AND THIRD SHOTS | trough 88 for a sand trap hole | tee box 84 for a pitching hole | trough 88 for a sand trap hole | long putting hole 102 or long start 110c on a putting hole 102 |
| SAND TRAP WITH SECOND AND THIRD SHOTS | trough 88 for a sand trap hole | tee box 84 for a pitching hole | tee box 100 for a chipping hole 94 | add strokes |
| SAND TRAP WITH SECOND AND THIRD SHOTS | trough 88 for a sand trap hole | tee box 84 for a pitching hole | tee box 100 for a chipping hole 94 | short putting hole 102 or short start 110a on a putting hole 102 |
| SAND TRAP WITH SECOND AND THIRD SHOTS | trough 88 for a sand trap hole | tee box 84 for a pitching hole | tee box 100 for a chipping hole 94 | intermediate putting hole 102 or intermediate start 110b on a putting hole 102 |
| SAND TRAP WITH SECOND AND THIRD SHOTS | trough 88 for a sand trap hole | tee box 84 for a pitching hole | tee box 100 for a chipping hole 94 | long putting hole 102 or long start 110c on a putting hole 102 |
| SAND TRAP* WITH SECOND AND THIRD SHOTS | trough 88 for a sand trap hole | trough 88 for a sand trap hole | tee box 84 for a pitching hole | add strokes |
| SAND TRAP* WITH SECOND AND THIRD SHOTS | trough 88 for a sand trap hole | trough 88 for a sand trap hole | tee box 84 for a pitching hole | short putting hole 102 or short start 110a on a putting hole 102 |
| SAND TRAP* WITH SECOND AND THIRD SHOTS | trough 88 for a sand trap hole | trough 88 for a sand trap hole | tee box 84 for a pitching hole | intermediate putting hole 102 or intermediate start 110b on a putting hole 102 |
| SAND TRAP* WITH SECOND AND THIRD SHOTS | trough 88 for a sand trap hole | trough 88 for a sand trap hole | tee box 84 for a pitching hole | long putting hole 102 or long start 110c on a putting hole 102 |
| SAND TRAP* WITH SECOND AND THIRD SHOTS | trough 88 for a sand trap hole | trough 88 for a sand trap hole | trough 88 for a sand trap hole | add strokes |
| SAND TRAP* WITH SECOND AND THIRD SHOTS | trough 88 for a sand trap hole | trough 88 for a sand trap hole | trough 88 for a sand trap hole | short putting hole 102 or short start 110a on a putting hole 102 |
| SAND TRAP* WITH SECOND AND THIRD SHOTS | trough 88 for a sand trap hole | trough 88 for a sand trap hole | trough 88 for a sand trap hole | intermediate putting hole 102 or intermediate start 110b on a putting hole 102 |
| SAND TRAP* WITH SECOND AND THIRD SHOTS | trough 88 for a sand trap hole | trough 88 for a sand trap hole | trough 88 for a sand trap hole | long putting hole 102 or long start 110c on a putting hole 102 |
| SAND TRAP* WITH SECOND AND THIRD SHOTS | trough 88 for a sand trap hole | trough 88 for a sand trap hole | tee box 100 for a chipping hole 94 | add strokes |
| SAND TRAP* WITH SECOND AND THIRD SHOTS | trough 88 for a sand trap hole | trough 88 for a sand trap hole | tee box 100 for a chipping hole 94 | short putting hole 102 or short start 110a on a putting hole 102 |

-continued

CHART OF POSSIBLE PAR 5 VIRTUAL HOLES (WITH FIRST PITCHING SHOT)

| HOLE TYPE | START | SECOND START | THIRD START | FINISH |
|---|---|---|---|---|
| SAND TRAP* WITH SECOND AND THIRD SHOTS | trough 88 for a sand trap hole | trough 88 for a sand trap hole | tee box 100 for a chipping hole 94 | intermediate putting hole 102 or intermediate start 110b on a putting hole 102 |
| SAND TRAP* WITH SECOND AND THIRD SHOTS | trough 88 for a sand trap hole | trough 88 for a sand trap hole | tee box 100 for a chipping hole 94 | long putting hole 102 or long start 110c on a putting hole 102 |
| SAND TRAP* WITH SECOND AND THIRD SHOTS | trough 88 for a sand trap hole | tee box 100 for a chipping hole 94 | tee box 84 for a pitching hole | add strokes |
| SAND TRAP* WITH SECOND AND THIRD SHOTS | trough 88 for a sand trap hole | tee box 100 for a chipping hole 94 | tee box 84 for a pitching hole | short putting hole 102 or short start 110a on a putting hole 102 |
| SAND TRAP* WITH SECOND AND THIRD SHOTS | trough 88 for a sand trap hole | tee box 100 for a chipping hole 94 | tee box 84 for a pitching hole | intermediate putting hole 102 or intermediate start 110b on a putting hole 102 |
| SAND TRAP* WITH SECOND AND THIRD SHOTS | trough 88 for a sand trap hole | tee box 100 for a chipping hole 94 | tee box 84 for a pitching hole | long putting hole 102 or long start 110c on a putting hole 102 |
| SAND TRAP* WITH SECOND AND THIRD SHOTS | trough 88 for a sand trap hole | tee box 100 for a chipping hole 94 | trough 88 for a sand trap hole | add strokes |
| SAND TRAP* WITH SECOND AND THIRD SHOTS | trough 88 for a sand trap hole | tee box 100 for a chipping hole 94 | trough 88 for a sand trap hole | short putting hole 102 or short start 110a on a putting hole 102 |
| SAND TRAP* WITH SECOND AND THIRD SHOTS | trough 88 for a sand trap hole | tee box 100 for a chipping hole 94 | trough 88 for a sand trap hole | intermediate putting hole 102 or intermediate start 110b on a putting hole 102 |
| SAND TRAP* WITH SECOND AND THIRD SHOTS | trough 88 for a sand trap hole | tee box 100 for a chipping hole 94 | trough 88 for a sand trap hole | long putting hole 102 or long start 110c on a putting hole 102 |
| SAND TRAP* WITH SECOND AND THIRD SHOTS | trough 88 for a sand trap hole | tee box 100 for a chipping hole 94 | tee box 100 for a chipping hole 94 | add strokes |
| SAND TRAP* WITH SECOND AND THIRD SHOTS | trough 88 for a sand trap hole | tee box 100 for a chipping hole 94 | tee box 100 for a chipping hole 94 | short putting hole 102 or short start 110a on a putting hole 102 |
| SAND TRAP* WITH SECOND AND THIRD SHOTS | trough 88 for a sand trap hole | tee box 100 for a chipping hole 94 | tee box 100 for a chipping hole 94 | intermediate putting hole 102 or intermediate start 110b on a putting hole 102 |
| SAND TRAP* WITH SECOND AND THIRD SHOTS | trough 88 for a sand trap hole | tee box 100 for a chipping hole 94 | tee box 100 for a chipping hole 94 | long putting hole 102 or long start 110c on a putting hole 102 |

*The hole types marked with an (*) are possible combinations that are not preferred, it being preferable that second shots on chipping holes and sand trap holes always be on pitching holes.

As explained above, further play on a pitching hole, a sand trap hole, or a chipping hole 94 is governed by where on the particular target 58 or 60 the ball lands. For pitch shots where the next shot is not a putt, then the scoring zones 66 indicate the type of hole on which to continue play, and for pitch shots where the next shot is a putt, the scoring zones indicate where to begin putting (or for short games, simply a number of strokes to add to the score). For chip shots and sand trap shots where the next shot is not a putt, the rings 80 and 82 indicate the type of hole on which to continue play, and for chip shots and sand trap shots in which the next hole is a putt, the scoring zones indicate where to begin putting (or for shot games, simply a number of strokes to add to the score).

Golf Game

A plurality of virtual holes can be combined to play a complete golf game. There are preferably nine or eighteen virtual holes in a game, to mimic the number of holes in a regular game of golf. The player places the ball at the starting point 110*a* on the putting surface 104 of a par 1 SHORT PUTT hole, the starting point 110*b* on the putting surface 104 of a par 2 MEDIUM PUTT hole, or the starting point 110*c* on the putting surface of a par 3 LONG PUTT hole, and continues play until the ball is putted into the cup 106.

The player places the ball on the tee box 100 of a par 2 chipping hole 94, and hits the ball toward the target 60, and adds a number of strokes to his or her score depending upon where the ball lands on the target 60.

The player places the ball on the tee box 84 of a par 3 pitching shot hole, and hits the ball toward the target 58, the tee box 100 of a chipping shot hole, or the trough 88 of a sand trap hole and hits the ball toward the target 60. The player continues on a putting hole 102, as determined by the location of the ball on target 58 or 60, or the player adds a number of strokes to his or her score depending upon where the ball lands on the target 58 or 60.

The player places the ball on the tee box 84 of a par four pitching hole, the tough 88 of a par four sand trap hole, or the tee box 100 of a par four chipping hole, and hits the ball to the appropriate target. Depending upon where the first ball lands, the player places a second ball on the tee box 84 and hits the ball toward the appropriate target 58, or places the ball in a trough 88 or a tee box 100 and hits the ball toward the appropriate target 60. Depending where the second ball lands on the target 58, play continues at the appropriate starting point 110*a*, 110*b*, or 110*c* of a putting hole 102 or strokes are added to the score to complete the hole's final score, or where the ball lands on the target 60, play continues at the appropriate starting point 110*a*, 110*b*, or 110*c* of a putting hole 102 or putting strokes are added to the score to complete the hole's final score.

The player places the ball on the tee box 84 of a par five pitching hole, the trough 88 of a par five sand trap hole, or the tee box 100 of a par five chipping hole, and hits the ball to the appropriate target. Depending upon where the first ball lands, the player places a second ball on the tee box 84 and hits the ball toward the appropriate target 58, or places the ball in a trough 88 or tee box 100 and hits the ball toward the appropriate target 60. Depending upon where the second ball lands, the player places a third ball on the tee box 84 of a pitching hole and hits the ball toward the appropriate target 58, or places the ball in a trough 88 of a sand trap hole or a tee box 100 of a chipping hole, an(l hits the ball toward the appropriate target 60. Depending where the third ball lands oil the target 58 or target 60, play continues at the appropriate starting point 110*a*, 110*b*, or 110*c* of inputting hole 102, or putting strokes are added to determine the hole's score.

FIG. 9 is a drawing of a score card of a possible round of golf that might be played on the facility. The first hole is a par 4. The player places a ball on the #326 tee box 84, and hits the ball toward the appropriate target 58, which can be identified by signage at the tee box or on the score card. Depending upon where the ball lands, the player continues at the #301 tee box 84, the #351 tee box 100, the #366 slot at trough 88, and the second shot result determines the starting distance at the #370 putting hole 102, that concludes the first hole. The second hole is a par 5. The player places a ball on the #399 tee box 84, and hits the ball toward the appropriate target 58. Depending upon where the first ball lands, the player continues with a second shot at the #349 tee box 84, the #353 tee box 100 or the #362 slot at trough 88. Depending upon where the second ball lands, the player continues at the #310 tee box 84, the #353 tee box 100, the #362 slot at trough 88. Depending where the third ball lands, the player continues playing at the #390 putting hole 102. The third hole is a par 3. The player places the ball in the #360 slot in trough 88 and hits the ball toward the appropriate target 60. Depending upon where the ball lands, play continues on the #395 putting hole. The fourth hole is a par 4. The player places the ball on the #352 tee box 100, and hits the ball toward the appropriate target 60. Depending upon where on the target 60 the ball lands, play continues on the #300 tee box 84, either as a fairway grade shot, a rough grade shot, or a deep rough grade shot. The circle on the score card indicates that the rings 70, 72, and 74 on the target 58 determine the number of putt strokes to add to the score, rather than finishing on a putting hole. The fifth hole is a par 1. The player places the ball on the #371 putting hole 102, and putts the-ball into the cup 106. The sixth hole is a par 5. The player places the ball in the #302 tee box 84 and hits the ball toward the appropriate target 58. Depending upon where the first ball lands, the player continues play at the #341 tee box 84 and hits the ball toward the appropriate target 58, or continues play at the #358 tee box 100 or the #367 slot in trough 88 and hits the ball to the appropriate target 60. Depending upon where on the target 58 or the target 60 the second ball land, play continues on the #338 tee box 84 and the player hits the ball toward the appropriate target 58, or play continues on the #357 tee box 100 or the #365 slot in trough 88, and the player hits the ball toward the appropriate target 60. The circles on the score card indicate that the rings 70, 72 and 74 on target 58 and the rings 80 and 82 on the target 60 are used to determine the number of putting strokes to add to the score, rather than finishing on a putting hole. The seventh hole is a par 2. The player places the ball on the #359 tee box 100, and hits the ball toward the appropriate target 60. The circle on the score card indicates that rings 80 and 82 are used to determine the number of putting strokes to add to the score, rather than finishing on a putting hole. The eighth hole is a par 4. The player places the ball on the #363 slot in trough 88 and hits the ball toward the appropriate target 60. Depending upon where on the target 60 the ball lands, play continues on the #303 tee box 84, either as a fairway grade shot, a rough grade shot, or a deep rough grade shot, and the player hits the ball toward the appropriate target 58. Depending upon where the ball lands on target 58, play continues at the corresponding distance on the #386 putting hole 102. The ninth hole is a par three. The player places the ball on the #397 tee box 84, and hits the ball toward the appropriate target 58. The circle on the score card indicates that the scoring rings 70, 72 and 74 on target 58 are used to determine the number of putting strokes to add to the score, rather than finishing on a putting hole.

The golf facility of the present invention can be compactly arranged, yet provide a complete golf game and practice area using the full of golf short game shots. The facility can be so compactly arranged that it can be constructed indoors. The facility can be used to play interesting and challenging golf games that hold the players' interest and improve their short game skills.

Operation

According to a preferred embodiment, a facility is provided with a plurality of virtual golf holes, each comprised of one or more short-shot holes. Each of the short-shot holes comprising one of the virtual golf holes comprises a plurality of starting points, each starting point (other than the starting point at the first of the short-shot holes comprising the virtual hole) having a different surface characteristic. Each of the short-shot holes also comprises a target with a plurality of zones. The player places a ball at one of the starting points and hits the ball toward one of the targets. Each of the zones corresponds to a particular surface type on the subsequent short-hole from which the player will hit his or her ball. Thus, where on the target the ball lands determines the type of surface from which the player will hit his or her subsequent shot on the next short-shot hole comprising the virtual hole.

For example, a player may start play on a virtual hole at a first short-shot hole where all of the starting points are conventional tee boxes. The player places the ball on the tee box and hits the ball toward the target. Where the ball lands relative to the target on the first short-shot hole determines the type of surface from which the player hits on the second short shot hole comprising the virtual hole. Similarly, where the ball lands relative to the target on the second short-shot hole determines the type of surface from which the player hits on the third short-shot hole. In general, after the first short-shot hole in a virtual hole, the surface from which the player hits a shot depends upon where the ball landed on the prior short-shot hole. Play continues in this fashion until the virtual hole is completed.

In play, a ball might land in a zone on the target of a short-shot hole corresponding to a fairway shot. In this case the player would go to a starting point on the subsequent short-shot hole comprising the virtual hole that has starting point with a surface simulating fairway—e.g., moderate turf depth. The ball might alternatively land in a zone on the target of the a short-shot hole corresponding to a rough shot. In this case the player would go to a starting point on the subsequent short-shot hole comprising the virtual hole that has a starting point with a surface simulating rough—e.g., deep turf. The ball might alternatively land in a zone on the target of the first shot hole that corresponds a sand trap. In this case the player would go to a starting point on the subsequent short shot hole comprising the virtual hole that has a starting point with a surface simulating a sand trap—e.g., a sand pit. Of course different grades of sand can be provided, and zones on the target can be designated not just to represent a sand shot, but sand shot from a particular grade of sand. The ball might alternatively land in a zone on the target of a short-shot hole comprising the virtual hole corresponding to a bunker shot. In this case the player would go to the starting point on the subsequent short-shot hole that has a starting point simulating a bunker. For example the starting point may be in a depressed section, or there may be a hill, wall, or other obstacle in front of the starting point over which the player must hit.

Some of the starting points for the short-shot holes may have a turf surface simulating play on a fairway. This would be natural or artificial turf having a height, for example, of between about ¾ of an inch and about 1¼ inches. Some of the starting points for the short-shot holes may have a turf surface simulating play on a rough. This would be a natural or artificial turf having a height, for example, greater than about 1½ inches. Some of the starting points for the short-shot holes may have a turf simulating play on the fringe of a green. This would be natural or artificial turf having a height, for example, of about ¾ of an inch. Some of the starting points for the short shot holes may have a turf simulating putting play. This would be a natural or artificial turf surface having a height, for example, of less than about 5/32 of an inch.

Some of the starting points for the short shot holes may have a surface simulating sand trap play. This would be a surface of sand. There can be just one grade of sand, or several different grades of sand could be provided. For example some of the starting points could be pits of masonry grade sand, a coarse, brown sand, and other of the starting points could be pits of silica grade sand, a fine, white sand.

Some of the starting points for the short shot holes may have a surface simulating bunker play. This could be a turf or sand surface, of one of the textures described above, in which the starting point is depressed relative to the surrounding area, or in which a wall or hill is formed in front of the starting point, over which the player must hit. It is possible to form a sloped depression, or a sloped wall or hill to form a plurality of starting points with different effective depths. Some zone on the target can correspond to shots of deeper effective depths, and other zones on the target can correspond to shots of shallower effective depths.

The player completes the game by playing a predetermined number of virtual holes, each of which comprises at lease one, and preferably more than one short-shot holes. For at least each shot after the first shot on the first short-shot hole comprising a virtual hole, the type of surface from which a subsequent shot is taken depends upon where the prior ball lands.

Referring to the above example of a Golf Game in which a player places the ball at the starting point 110*a* on the putting surface 104 of a par 2 or par 3 hole, a further method of playing a golf type game is provided. The method entails play on at least one golf hole that includes a first putting golf shot area having a target area with a more favorable and less favorable target zone, and at least one short-game golf shot area that is a separate area of play from the first putting golf shot area. The method comprises (a) putting a ball from a starting point on the first putting golf shot area towards the putting target area on the first putting golf shot area, and (b) placing a ball at a starting point on a separate short-game golf shot area, and (c) hitting the ball towards a target area on the separate short-game golf shot. The starting point on the separate short-game golf shot area includes at least a more favorable surface type and at least a less favorable surface type. The step of placing the ball at a starting point comprises placing the ball on the more favorable surface type when the ball hit on the first putting golf shot lands in the more favorable target zone of the putting target area, or placing the ball on the less favorable surface type when the ball hit on the first putting golf shot lands in the less favorable target zone of the putting target area. In the above method, the first putting golf shot area may also comprise at least a more favorable starting point and a less favorable starting point. The ball may then be putted from either the more favorable or less favorable starting point, depending on where a ball hit on the preceding golf hole finishes landing relative to one or more target zones on the preceding golf hole. The ball is preferably placed on the more favorable surface type when the ball hit on the preceding golf hole finished landing on a more favorable target zone, or the ball is placed on the less favorable surface type when the ball hit on the preceding golf hole finished landing on a less favorable target zone.

What is claimed is:

1. A method of playing a golf type game including at least one golf hole having a first putting golf shot having a putting target area within which is at least a more favorable target zone and a less favorable target zone, followed by at least a second non-putting short-game golf shot at a separate area of play from the first putting golf shot, and having a target area that includes at least a more favorable target zone and a less favorable target zone, the method comprising:

(a) putting a ball from a starting point for the first putting golf shot towards the putting target area;

(b) placing a ball at a separate starting point for the second short-game golf shot, and (c) hitting the ball towards a separate target area on the second short-game golf shot;

wherein the number of different surface types for the starting point for the second non-putting short-game golf shot includes at least a more favorable surface type and at least a less favorable surface type, and the step of placing the ball at a starting point comprises placing the ball on the more favorable surface type when the ball hit on the first putting golf shot finishes landing in the more favorable target zone of the putting short-game target area, or on the less favorable surface type when the ball hit on the first putting golf shot finishes landing in the less favorable target zone of the putting short-game target area.

2. The method of claim 1 further comprising the step of placing a ball at a starting point of a subsequent golf hole following the preceding at least one golf hole, wherein the starting point has a more favorable surface type and a less favorable surface type, and the ball is placed on either the more favorable or less favorable surface type depending on where a ball hit on the preceding golf hole finished landing relative to one or more target areas on the preceding golf hole.

3. The method of claim 2 wherein the ball is placed on the more favorable surface type when the ball hit on the preceding golf hole finished landing on a more favorable target zone, or the ball is placed on the less favorable surface type when the ball hit on the preceding golf hole finished landing on a less favorable target zone.

4. A method of playing a golf type game including at least one golf hole having a first putting golf shot area on which at least one stroke is played, followed by at least a second non-putting short-game golf shot area on which at least one stroke is played, the method comprising:

(a) putting a ball from a starting point for the first putting short-game golf shot area towards a target area on the first putting short-game shot area within which is at least a more favorable target zone and a less favorable target zone;

(b) placing a ball at a starting point for the second short-game golf shot area, which starting point includes at least a more favorable surface type and a less favorable surface type, and (c) hitting the ball towards a target area on the second short-game golf shot area that includes at least a more favorable target zone and a less favorable target zone;

wherein the ball is placed at the starting point for the second short-game golf shot area on a more favorable surface type when the ball hit on the first putting golf shot area finishes landing in the more favorable target zone.

5. The method of claim 4 wherein the first putting golf shot area comprises at least a more favorable starting point and a less favorable starting point, and the ball is hit from either the more favorable or less favorable starting point depending on where a ball hit on a preceding golf hole finishes landing relative to the target zones on the preceding golf hole's last short-game golf shot.

6. A method of playing a golf type game including at least one golf hole having a par of at least two strokes, wherein the at least one golf hole comprises a putting golf shot area on which at least one stroke is played, and which has a target area within which is a more favorable target zone and a less favorable target zone, followed by at least one separate non-putting short-game golf shot area on which at least one stroke is played, the method of playing comprising: (a) placing a ball on one of at least a more favorable starting point or a less favorable starting point of the putting golf shot area, (b) putting the ball towards a target area; (c) placing a ball on one of at least a more favorable surface type or a less favorable surface type on a subsequent non-putting short game golf shot area, wherein the ball is placed on the more favorable surface type for the subsequent non-putting short-game golf shot hole when the ball hit on the first putting golf shot area finishes landing in the more favorable target zone; and (d) hitting the ball towards a target area on the subsequent non-putting short game golf shot area that includes a more favorable target zone and a less favorable zone.

7. The method of claim 6 wherein the more favorable surface type is a fairway grade turf.

8. The method of claim 6 wherein the less favorable surface type is a rough grade turf.

9. The method of claim 6 further comprising the step of placing a ball at a starting point of a subsequent golf hole following the preceding at least one golf hole, wherein the starting point has a more favorable surface type and a less favorable surface type, and the ball is placed on either the more favorable or less favorable surface type depending on where a ball hit on the preceding golf hole finished landing relative to one or more target areas on the preceding golf hole.

10. A method of playing a golf type game having at least one golf hole that includes a first putting golf shot area having a target area that includes a more favorable target zone and a less favorable target zone, and at least one short-game golf shot area that is a separate area of play from the first putting golf shot area, the method comprising:

(a) putting a ball from a starting point on the first putting golf shot area towards the putting target area on the first putting golf shot area;

(b) placing a ball at a starting point on a separate short-game golf shot area, wherein the starting point on the separate short-game golf shot area includes at least a more favorable surface type and at least a less favorable surface type, and the step of placing the ball at a starting point comprises placing the ball on the more favorable surface type when the ball hit on the first putting golf shot finishes landing in the more favorable target zone of the putting target area, or placing the ball on the less favorable surface type when the ball hit on the first putting golf shot finishes landing in the less favorable target zone of the putting target area; and (c) hitting the ball towards a target area on the separate short-game golf shot.

11. The method of claim 10 wherein the less favorable surface type is a rough grade turf.

12. The method of claim 10 wherein the first putting golf shot area comprises at least a more favorable starting point and a less favorable starting point, and the ball is hit from either the more favorable or less favorable starting point depending on where a ball hit on the preceding golf hole finishes landing relative to one or more target zones on the preceding golf hole.

* * * * *